US010844651B2

(12) United States Patent
Koster et al.

(10) Patent No.: US 10,844,651 B2
(45) Date of Patent: Nov. 24, 2020

(54) COMPRESSION GASKET FOR SEALING A WINDOW IN A WINDOW FRAME

(71) Applicant: Matrex Window System Inc., Vaughan (CA)

(72) Inventors: Norman Koster, Richmond Hill (CA); Angelo Forgione, Woodbridge (CA)

(73) Assignee: Matrex Window System Inc., Vaughan (CA)

( * ) Notice: Subject to any disclaimer, the term of this patent is extended or adjusted under 35 U.S.C. 154(b) by 0 days.

(21) Appl. No.: 16/046,375

(22) Filed: Jul. 26, 2018

(65) Prior Publication Data

US 2020/0032572 A1 Jan. 30, 2020

(51) Int. Cl.

| | |
|---|---|
| ***E06B 3/62*** | (2006.01) |
| ***E06B 7/23*** | (2006.01) |
| ***E06B 3/96*** | (2006.01) |

(52) U.S. Cl.

CPC ..... *E06B 3/62* (2013.01); *E06B 3/9616* (2013.01); *E06B 7/2312* (2013.01); *E06B 2003/6223* (2013.01); *E06B 2003/6244* (2013.01)

(58) Field of Classification Search

CPC ..... E06B 3/62; E06B 3/9616; E06B 7/2312; E06B 2003/6223; E06B 2003/6244

See application file for complete search history.

(56) References Cited

U.S. PATENT DOCUMENTS

| | | | |
|---|---|---|---|
| 3,189,140 | A | 6/1965 | Luss |
| 3,593,963 | A | 7/1971 | Horgan |
| 3,881,290 | A | 5/1975 | Bouchey |
| RE28,643 | E | 12/1975 | Blum |
| 4,054,268 | A | 10/1977 | Sher |
| 4,067,548 | A | 1/1978 | Murphy |
| 4,074,490 | A | 2/1978 | Nagase |
| 4,103,874 | A | 8/1978 | Horgan |

(Continued)

FOREIGN PATENT DOCUMENTS

| | | |
|---|---|---|
| DE | 2061005 A1 | 6/1972 |
| DE | 3540961 A1 | 5/1987 |

(Continued)

OTHER PUBLICATIONS

USPTO Public Patent Application Information Retrieval Image File Wrapper for U.S. Appl. No. 16/046,226, downloaded from http://www.uspto.gov on Oct. 14, 2019.

(Continued)

*Primary Examiner* — Adriana Figueroa
(74) *Attorney, Agent, or Firm* — Baker & McKenzie LLP

(57) ABSTRACT

Embodiments described herein may be directed to the functional application and method of use of the compression gasket for sealing a window installed in a window frame. In accordance with the present disclosure, a compression gasket may comprise soft rubber portion that applies pressure against a window surface. The soft rubber portion may compress, causing a rigid plastic portion that to bow outwardly and engage inner surfaces of the window frame. The bowing out of the rigid plastic portion, which may include a leaf spring, may secure the compression gasket to the window frame. The compression gasket may be designed to stop water leakage that may occur between the window and the window frame.

14 Claims, 8 Drawing Sheets

(56) References Cited

U.S. PATENT DOCUMENTS

| | | | |
|---|---|---|---|
| 4,115,972 | A | 9/1978 | Varlonga |
| 4,599,838 | A | 7/1986 | Kaminaga |
| 4,614,062 | A | 9/1986 | Sperr |
| 4,754,585 | A | 7/1988 | Rundo |
| 4,825,609 | A | 5/1989 | Rundo |
| 4,913,976 | A | 4/1990 | Brooks et al. |
| 4,941,289 | A | 7/1990 | Rolek |
| 5,105,593 | A | 4/1992 | Kaminaga et al. |
| 5,212,922 | A | 5/1993 | Werner |
| 5,544,457 | A | 8/1996 | Labrecque |
| 5,618,127 | A | 4/1997 | Tonsmann et al. |
| 5,635,274 | A | 6/1997 | Kohji et al. |
| 6,141,923 | A | 11/2000 | Habicht et al. |
| 6,517,056 | B2 | 2/2003 | Shepherd |
| 6,662,512 | B2 | 12/2003 | Westphal |
| 8,181,405 | B2 | 5/2012 | Nash |
| 8,776,477 | B2 | 7/2014 | Sprague |
| 9,163,449 | B2 | 10/2015 | Weiss et al. |
| 9,475,374 | B2 | 10/2016 | Murree et al. |
| 9,777,484 | B2 | 10/2017 | Header |
| 10,081,978 | B2 | 9/2018 | Weiss et al. |
| 2013/0000232 | A1 | 1/2013 | Weiss et al. |
| 2016/0060945 | A1 | 3/2016 | Weiss et al. |
| 2016/0340895 | A1 | 11/2016 | Deiss et al. |
| 2018/0340363 | A1 | 11/2018 | Pannunzio |

FOREIGN PATENT DOCUMENTS

| | | | | |
|---|---|---|---|---|
| DE | 4412414 | A1 * | 12/1994 | E06B 3/62 |
| DE | 9302781 | U1 * | 5/1995 | E06B 3/308 |
| DE | 19640041 | A1 * | 4/1998 | E06B 3/62 |
| EP | 0291017 | A1 * | 11/1988 | E06B 3/62 |
| EP | 0611870 | A1 * | 8/1994 | E06B 3/62 |
| EP | 0653542 | A2 * | 5/1995 | E06B 3/62 |
| EP | 0834639 | A1 * | 4/1998 | E06B 3/308 |
| EP | 2369116 | A2 * | 9/2011 | E06B 3/62 |
| FR | 2734019 | A1 * | 11/1996 | E06B 3/62 |
| FR | 2801922 | A1 * | 6/2001 | E06B 3/62 |
| GB | 2325954 | A * | 12/1998 | E06B 3/62 |
| GB | 2352262 | A * | 1/2001 | E06B 3/62 |
| NL | 1000412 | C2 * | 11/1996 | E06B 1/36 |

OTHER PUBLICATIONS

USPTO Public Patent Application Information Retrieval Image File Wrapper for U.S. Appl. No. 16/046,317, downloaded from http://www.uspto.gov on Oct. 14, 2019.

USPTO Public Patent Application Information Retrieval Image File Wrapper for U.S. Appl. No. 16/046,333, downloaded from http://www.uspto.gov on Oct. 14, 2019.

USPTO Public Patent Application Information Retrieval Image File Wrapper for U.S. Appl. No. 16/046,357, downloaded from http://www.uspto.gov on Oct. 14, 2019.

Koster et al., U.S. Appl. No. 16/046,317, 700 pages.

Koster et al., U.S. Appl. No. 16/163,214, 204 pages.

Koster et al., U.S. Appl. No. 16/046,226, 721 pages.

Koster et al., U.S. Appl. No. 16/046,333, 724 pages.

Office Action dated Oct. 17, 2019 in connection with U.S. Appl. No. 16/163,214, 14 pages.

Office Action dated Oct. 23, 2019 in connection with U.S. Appl. No. 16/046,333, 8 pages.

Office Action dated Jun. 27, 2019 in connection with U.S. Appl. No. 16/046,226, 9 pages.

* cited by examiner

COMPRESSION GASKET FOR SEALING A WINDOW IN A WINDOW FRAME

TECHNICAL FIELD

Embodiments disclosed herein relate to the functional role, design, and method of use of a compression gasket for sealing a window in a window frame.

BACKGROUND

Window frames are designed to provide structure and visibility while protecting interior spaces from the natural elements (e.g., water and wind). Manufacturers of windows and window frames are constantly seeking to improve the functional efficacy of their products, particularly with respect to ensuring proper sealing between window panes and window frames, as well as between adjacent window frames. Accordingly, there is a need for improved functional ability for protecting users from the natural elements as well as for improved window installation processes.

SUMMARY

In some embodiments, a compression gasket for a window wall may comprise a first portion having a top end and a bottom end. In some embodiments the top end may comprise a top surface for engaging a first surface of a window frame extrusion, and the bottom end may comprise a bottom surface for engaging a second surface of the window frame extrusion. Further, in some embodiments of the compression gasket a second portion may comprise at least one protrusion for engaging a window surface to create a seal, wherein when the at least one protrusion engages the window surface, the second portion may compress toward the first portion, causing the first portion to expand outwardly such that the top surface of the first portion may exert a first force against the first surface of the window frame extrusion and the bottom surface of the first portion may exert a second force against the second surface of the window frame extrusion.

In some embodiments, the compression gasket may be comprised of a top end of the first portion and a top foot to be received in a top cavity of the window frame extrusion, wherein the bottom end of the first portion may comprise a bottom foot to be received in a bottom cavity of the window frame extrusion.

In some embodiments, the compression gasket may operatively couples to the window frame extrusion by compressing the first portion inwardly on itself by exerting at least one of a third force in the direction of the second force against the top surface and a fourth force in the direction of the first force against the bottom surface. Further, the compression gasket may insert the top and bottom feet into the top and bottom cavities of the window frame extrusion, respectively, wherein once inserted, the top and bottom feet may engage the window frame extrusion so as to secure the compression gasket to the window frame extrusion.

In some embodiments, the shapes of the top and bottom feet of the compression gasket may substantially match respective contours of the top and bottom cavities of the window frame extrusion.

In some embodiments, the first portion of the compression gasket may comprise a leaf spring.

In some embodiments, the first portion of the compression gasket may be comprised of a rigid material.

In some embodiments, second portion of the compression gasket may be comprised of a non-rigid material.

In some embodiments, the first and second portions of the compression gasket may be manufactured from different materials.

In some embodiments, the first and second portions of the compression gasket may be manufactured from a common material.

In some embodiments, the first and second portions of the compression gasket may be coupled together using at least one of an adhesive, a pin, a screw, a clip, a coupling, and a bonding process.

In some embodiments, a method comprising a window frame configured to receive a window, wherein the window frame may comprise an upwardly extending extrusion. The extrusion may comprise an opening with a first surface and a second surface opposite the first surface. The extrusion may provide a compression gasket, wherein the compression gasket may comprise a first portion having a top end and a bottom end. The top end may comprise a top surface for engaging the first surface of the extrusion, and the bottom end may comprise a bottom surface for engaging the second surface of the extrusion. In some embodiments, a second portion of the compression gasket may be operatively coupled to the first portion and may comprise at least one protrusion which may operatively couple the compression gasket to the window frame by securing the first portion within the opening of the extrusion. In installing the window in the window frame, wherein the at least one protrusion engages a surface of the window to create a seal and, wherein when the at least one protrusion engages the window surface, the second portion may compress toward the first portion, causing the first portion to expand outwardly such that the top surface of the first portion exerts a first force against the first surface of the window frame extrusion and the bottom surface of the first portion exerts a second force against the second surface of the window frame.

In some embodiments, the top end of the first portion may comprise a top foot to be received in a top cavity of the window frame extrusion, wherein the bottom end of the first portion may comprise a bottom foot to be received in a bottom cavity of the window frame extrusion.

In some embodiments, the method of operatively coupling the compression gasket to the window frame may further comprise compressing the first portion inwardly on itself by exerting at least one of a third force in the direction of the second force against the top surface and a fourth force in the direction of the first force against the bottom surface and inserting the top and bottom feet into the top and bottom cavities, respectively, wherein once inserted, the first portion may expand outwardly so that the top and bottom feet engage the extrusion. In so doing, the compression gasket may be secured to the window frame.

In some embodiments, the shapes of the top and bottom feet may substantially match respective contours of the top and bottom cavities of the window frame extrusion.

In some embodiments, the first portion of the compression gasket may comprise a leaf spring.

In some embodiments, the first portion of the compression gasket may be comprised of a rigid material.

In some embodiments, the second portion of the compression gasket may be comprised of a non-rigid material.

In some embodiments, the first and second portions of the compression gasket may be manufactured from different materials.

In some embodiments, the first and second portions of the compression gasket may be coupled together using at least one of an adhesive, a pin, a screw, a clip, a coupling, and a bonding process.

In some embodiments, a window frame may be configured to receive a window and may comprise an extrusion. The extrusion may comprise an opening with a first surface and a second surface opposite the first surface, wherein the opening may be configured to receive a first portion of a compression gasket, the first portion having a top end and a bottom end, wherein the top end comprises a top surface for engaging the first surface of the extrusion, and wherein the bottom end comprises a bottom surface for engaging the second surface of the extrusion. The compression gasket may further have a second portion comprising at least one protrusion for engaging a surface of the window, wherein when the at least one protrusion engages the surface of the window, the second portion compresses toward the first portion, causing the first portion to expand outwardly such that the top surface of the first portion exerts a first force against the first surface of the extrusion and the bottom surface of the first portion exerts a second force against the second surface of the extrusion.

BRIEF DESCRIPTION OF THE DRAWINGS

Reference is now made to the following descriptions taken in conjunction with the accompanying drawings.

DETAILED DESCRIPTION

Various aspects of the components of a window frame design and the underlying elements of the disclosed embodiments involved in the mechanism, installation, and function of the window frame, as outlined in the present disclosure, are described. It should be noted that the following explanations are merely exemplary in describing the inventions and methods of the present disclosure. Accordingly, several modifications, changes and substitutions are anticipated, and the following detailed description is not intended to limit the scope of the disclosure, as claimed. Further, while the descriptions that follow are meant to provide a detailed understanding of the disclosed embodiments of the window frame design, some embodiments may use part or all of the details herein described. It should be noted that the figures that follow depict drawings of a window frame and its underlying mechanism that are not to precise scale. Moreover, directional terms such as top, bottom, left, right, inside, outside, distal and proximal may be used with respect to the referenced figures in the text that follows, not to be related to anything beyond the referenced figures. Said differently, directional terms are not to be construed as limiting in scope of the disclosed inventions as they are merely descriptive of the figures that are referenced. For example, a side may refer to at least one of a top side, a bottom side, a left side, a right side, a front side, a rear side, a surface, an edge, and/or the like. Finally, descriptive words such as ridges, ribs, and anchors, in the plural or singular, may be used interchangeably to describe various aspects of the invention depending on the embodiment of the window frame and its underlying components.

Figure 1A:
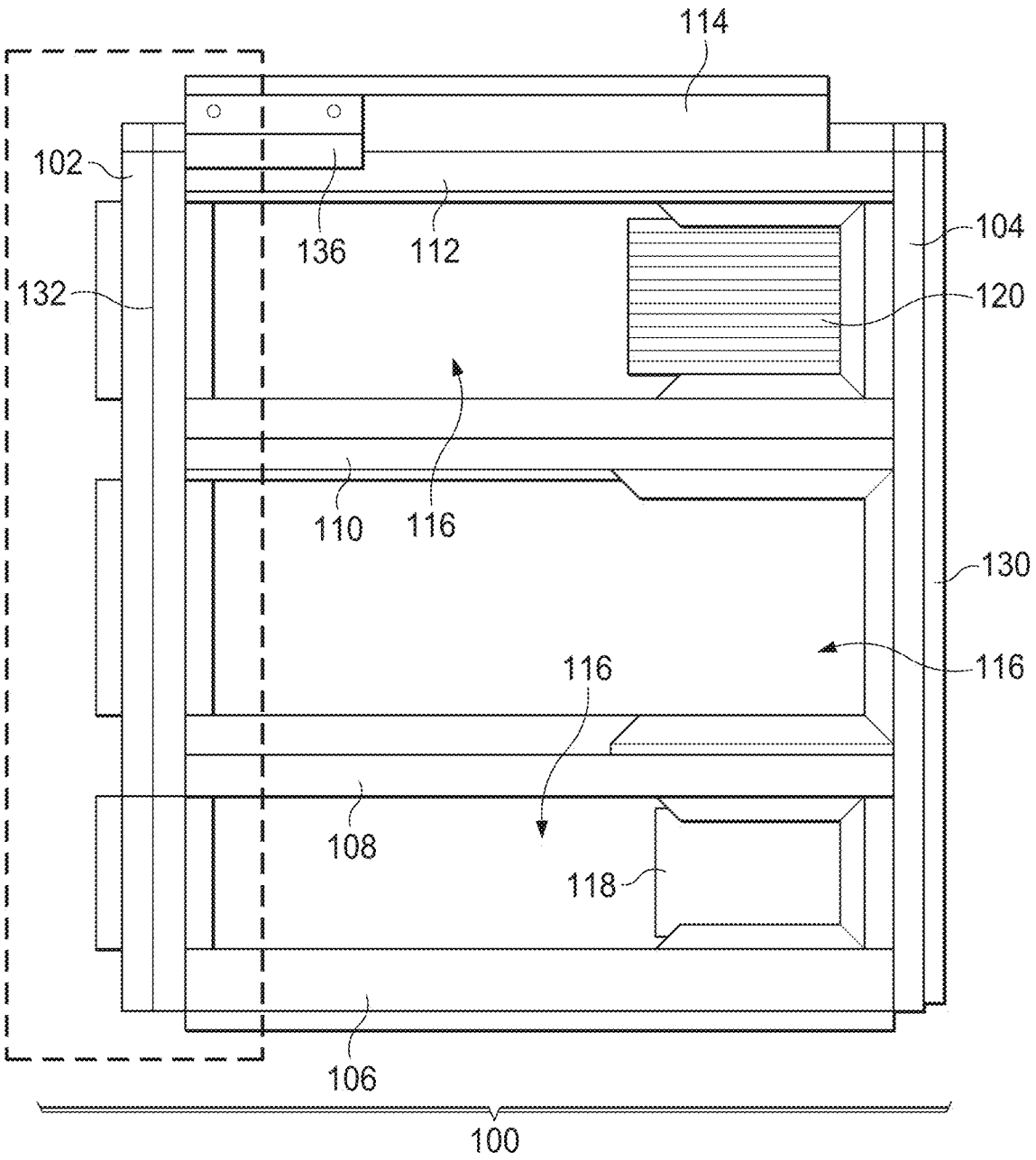
FIG. 1A illustrates a front view of a window frame, in accordance with some embodiments of the disclosure.
Figure 1B:
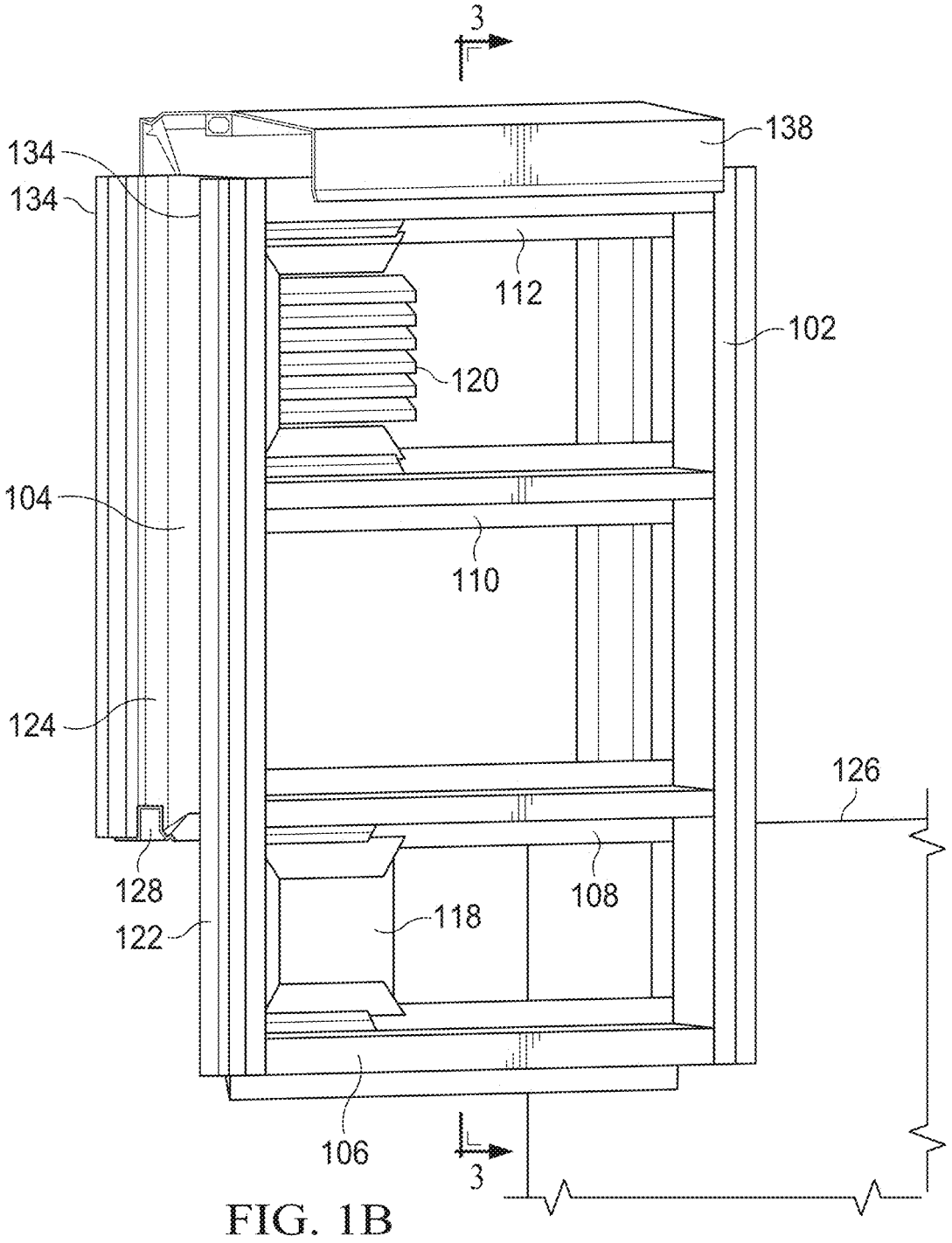
FIG. 1B illustrates a perspective view of a window frame and sill, in accordance with some embodiments of the disclosure.

FIG. 1A may illustrate a front view of a window frame 100, and FIG. 1B may illustrate a perspective view of the same 100. As depicted, the window frame 100 may include six body sides: a front, a top, a bottom, a left side, a right side and a rear. In some embodiments, the window frame 100 may include a first vertical window frame jamb 102, a second vertical window frame jamb 104, at least one window frame rail (e.g., a first window frame rail 106, a second window frame rail 108, a third window frame rail 110, and a fourth window frame rail 112), and a window frame header 114. Each of these window frame sections may operatively couple to each other using one or more couplings (e.g., pins, screws, nails, bolts, clips, inserts, gaskets, magnets, and/or the like). Additionally, each window frame section may couple to one or more other window frame sections using a gasket connection as discussed in greater detail below.

Broadly, the materials used to manufacture the window frame 100 may include one or more rigid or non-rigid materials. Each element and/or sub-element of the window frame 100 described herein may be manufactured from at least one of a rigid material, a non-rigid material, and a plurality of different materials. For example, the window frame 100 may be manufactured from a derivative of an aluminum based alloy in one embodiment, and in other embodiments may be comprised of a range of other alloys whose core component could be copper, zinc, tin, iron, nickel, gold, and/or the like. Additionally and/or alternatively, a synthetic polymer could be used (e.g., high-density polyethylene, low density polyethylene, polypropylene, polyvinyl chloride, polystyrene, polyethylene terephthalate, and/or the like), as well as fiberglass. Window frame material selection may be influenced by geographic location and/or a size or type of structure into which the window frame is to be installed, as well as other factors such as heat index, temperature fluctuations, humidity, precipitation, seismic activity, wind conditions, and/or the like.

The first, second, third, and fourth window frame rails 106, 108, 110, 112 may define a contour of windowpane openings 116 of the window frame 100. For example, the window frame 100 may include at least one opening 116, where each opening 116 is defined between two or more window frame rails 106, 108, 110, 112 of the window frame 100.

In some embodiments, each opening 116 may be configured to receive at least one piece of glass and/or another material within its interior and/or on one or more of its surfaces. In other embodiments, at least one side of each opening 116 may be at least partially covered by glass 118 and/or other materials 120. Like material selection for the window frame 100, which is discussed non-exhaustively above, glass type selection (whether to use float glass, shatterproof glass, laminated glass, chromatic glass, tinted glass, tempered glass, insulated glass, toughened glass, and/or the like) may depend on several factors such as transparency, strength, workability, transmittance, U-value, color, and/or cost, among other things. Selection may also be based on a desired functionality or utility of the window frame 100. Geographic location may also play a role in glass type selection due to the impact that temperature fluctuations, humidity, and/or precipitation may have on glass durability, its propensity to contract and/or expand, and/or other factors. Likewise, selection of any other material that may cover openings in the window, such as opening 116 and/or other windowpane openings, may depend on the possible use of the window.

A range of shapes may be enabled to fit within the opening 116 and/or otherwise operatively couple to the window frame 100 so that the opening 116 is substantially covered. The shape of each opening 116 may be rectangular as depicted in the drawings, square, rhombical, circular, oval, or curved glass designs in other embodiments. In some embodiments, a window frame rail (e.g., window frame rail 110) or other element of the window frame 100 may serve as a divider between adjacent openings 116 of the window frame 100. Importantly, the each window frame rail 106, 108, 110, 112 may be configured to hold a static position or may be movable (e.g., slidable along interior surfaces of the vertical window frame jambs 102, 104 and/or within an interior of the window frame 100) as part of a window sash (not pictured).

One or more elements of the window frame 100 may operatively couple with the use of fasteners and adhesives (e.g., blind fasteners, solid rivets, bolts, self fierce rivets, clinching, flow drill screws, mechanical interlock, electromagnetic formation, and/or the like), soldering (e.g., dip, furnace, induction, infrared, iron, resistance, torch, wave, and/or the like), brazing (e.g., atmosphere, diffusion, dip, furnace, infrared, laser, resistance, torch, and/or the like), solid state welding (e.g., cold, welding, diffusion, explosion, friction, friction stir seam, friction stir spot, magnetic pulse, and/or ultrasonic welding), resistance welding (e.g., resistance spot, weldbonding, resistance seam, projection, high frequency resistance, high frequency induction, flash, upset, and/or pressure welding), and/or via other methods. In other embodiments, ball-point joints, pivot joints, and/or the like may be used to allow for rotational or axial flexibility between elements of the window frame 100.

Importantly, FIG. 1B may illustrate a perspective view of the window frame 100 disposed on a mounting surface 126. The mounting surface 126 may be of a rigid consistency for constructing a stable structure such as a building, a house, and/or the like. In some embodiments, the surface 126 may be manufactured from steel, metal, and/or other alloy, wood, plastic, and/or concrete, which comes in a range of varieties (e.g., modern concrete, high-strength concrete, high-performance concrete, ultra high-performance concrete, stamped concrete, self-consolidating concrete, shotcrete, limecrete, vacuum concrete, polymer concrete, pre-stressed concrete, air entrained concrete, and/or the like). A bottom surface of the window frame stool 124, which may comprise a sill anchor 128, may rest on a top surface of the mounting surface 126. In some embodiments, when the window frame 100 is installed on the mounting surface 126, a bottom surface of the window frame stool 124 and/or the sill anchor 128 may engage a top surface of the mounting surface 126, thereby securing the window frame 100 to the mounting surface. While the mounting surface 126 may be concrete in some embodiments, the mounting surface 126 may also be comprised of a variety of synthetic polymers (e.g., high-density polyethylene, low density polyethylene, polypropylene, polyvinyl chloride, polystyrene, polyethylene terephthalate, and/or the like), different metal alloys (whose major component could be copper, zinc, tin, iron, nickel, gold, and/or the like), lumber (e.g., beech, oak, maple, pine, ash, mahogany, walnut, and/or the like) or lumber composites (e.g., plywood, densified wood, chemically densified wood, fireboard, particle board, oriented strand board, laminated timber, laminated veneer, cross laminated timber, parallel strand lumber, laminated strand lumber, finger joints, beams, trusses, transparent wood composites, and/or the like), and/or any other material. It should be noted that material selection and use may depend on the purported use of the window frame 100 as well as extraneous factors such as geographic location for window frame 100 use.

Sides of the window frame 100 may be defined by the first vertical window frame jamb 102 and the second vertical window frame jamb 104 in this embodiment. One or more window frame rails 106, 108, 110, 112 may also define a side of the window frame 100. The first vertical window frame jamb 102 may be positioned substantially parallel to the second vertical window frame jamb 104. Each vertical window frame jamb 102, 104 may include an indented rigid portion 130 used in connecting the window frame 100 to other adjacent window frames. In some embodiments, the indented rigid portion 130 may include one or more gasket couplings described with respect to FIGS. 2A and 2B. The indented rigid portion 130 may be included on any side of the window frame 100.

As seen in FIG. 1A, each vertical window frame jamb 102, 104 may also include a groove 132 running along its length. The groove 132 may be used in connecting the window frame 100 to other adjacent window frames. In some embodiments, the groove 132 may include one or more gasket couplings described with respect to FIGS. 2A and 2B. The groove 132 may be included on any side of the window frame 100. An indented rigid portion 130 of a first window frame may couple with a groove 132 of a second window frame adjacent to the first window frame. In this manner, adjacent window frames may operatively couple in consecutive succession in any direction, thereby forming an array of window frames.

As seen in FIG. 1A, a window frame header 114 may define a top surface of the window frame 110. The window frame header 114 may include an extension 136 for partially shielding an opening 116 and/or for another purpose.

Figure 2A:
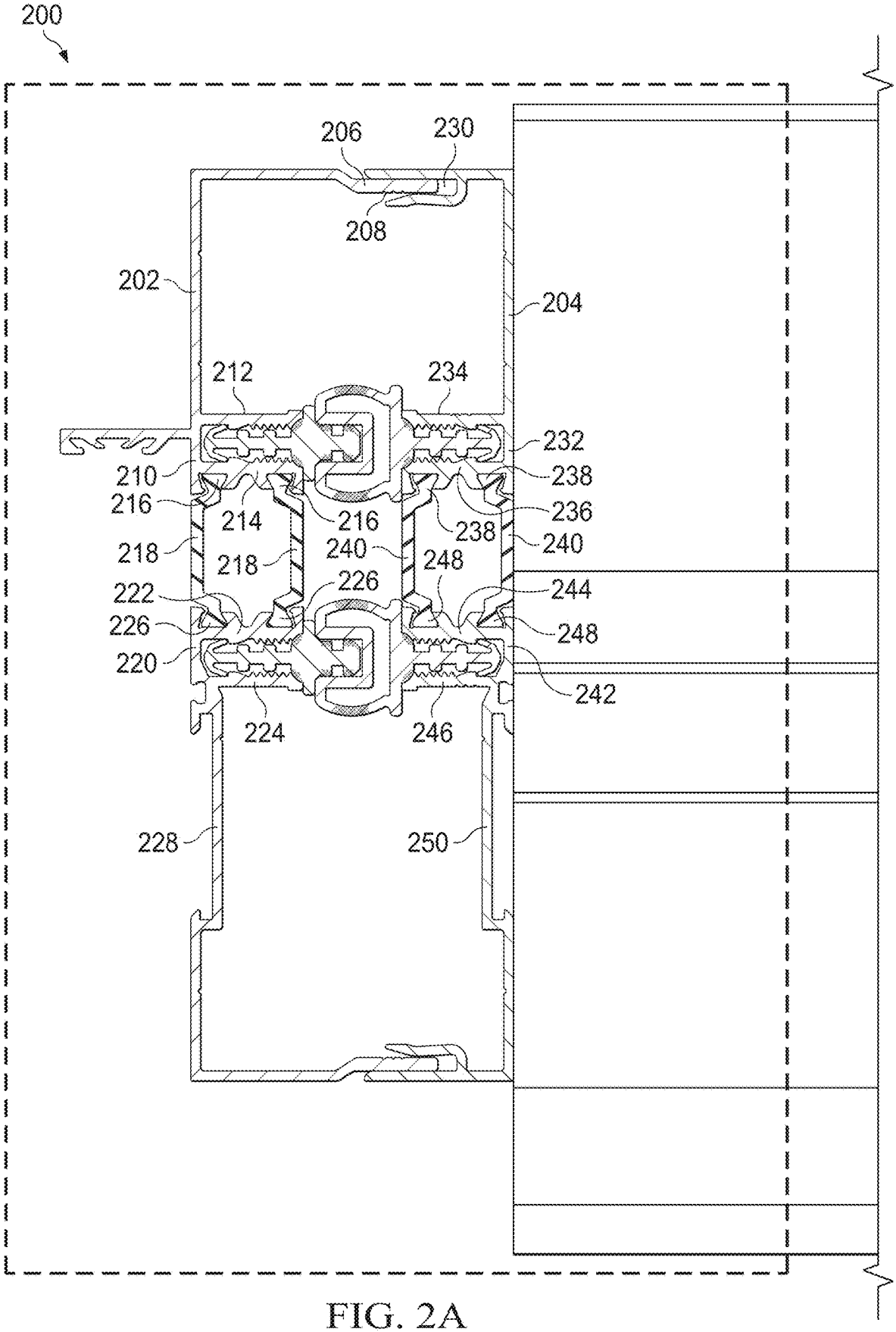
FIG. 2A illustrates a top view of a window frame gasket coupling, in accordance with some embodiments of the disclosure.

FIG. 2A may illustrate a top view 200 of the window frame 100 of FIGS. 1A and 1B, observing downward along a vertical axis of the first vertical window frame jamb 102. The first vertical window frame jamb 102 may comprise a male jamb portion 202 (e.g., an outer frame) and a female jamb portion 204 (e.g., an inner frame). The male jamb portion 202 may slide inside the female jamb portion 204 as adjacent window frames couple to one another. Coupled window frames may form a substantially planar arrangement (e.g., on the side of a building or house), and/or may form a substantially curved profile (e.g., on a curved corner of a building). Together, the connection formed between the male jamb portion 202 and the female jamb portion 204 may be substantially rigid in this embodiment, i.e., the components may be locked together and degrees of freedom (e.g., all degrees of freedom) that would allow for any movement of the joint may be removed. The joint, as used in this section, may refer to a connection between a male jamb portion 202 and a female jamb portion 204. A mechanism for rigidity, and a description of the different components that comprise an example embodiment joint follow. In some embodiments, the male and female jamb portions 202, 204 may couple using one or more clips, where a tip of the male jamb portion 202 is received into a clip of the female jamb portion 204 as described below.

The male jamb portion 202 may include a rigid frame and may have an indented tip 206 having at least one dimple 208. The tip 206 may extend to form a corner of the male jamb portion 202 that may bend substantially at approximately a right angle and toward the female jamb portion 204. From the corner, at a distance proximal to the middle of the male jamb portion 202 in one embodiment, may begin a first extrusion 210 of the male jamb portion 202 that may be comprised of the same rigid material as the rest of the outer frame. The first extrusion 210 of the male jamb portion 202 may extend outwardly from the male jamb portion 202 and toward the female jamb portion 204 at a substantially perpendicular angle to the male jamb portion's 202 outer frame.

The first extrusion 210 may include an outer extrusion wall 212 and an inner extrusion wall 214. The first extrusion 210 may include one or more small rib-like crevices on inner surfaces of the outer extrusion wall 212 and the inner extrusion wall 214. These crevices may be designed to secure one or more gaskets, e.g., a male gasket as discussed below, in place. The inner extrusion wall 214 may be positioned opposite the outer extrusion wall 212.

One or more cavities 216 may be disposed on the inner extrusion wall 214. Each cavity 216 may be configured to receive a connector 218 that links the first extrusion 210 to a second extrusion 220 extending outwardly from the male jamb portion 202. Each connector 218 may help maintain the male jamb portion 202 as one single continuous piece. In some embodiments, the male jamb portion 202 may include one frame piece and/or multiple frame pieces. The connector 218 may create a flexible joint type by their substantially dovetail joint structure at either end while providing a seal against water, wind, and/or other weather elements. In other embodiments, the joint of the connector 218 may be of a different shape (e.g., circular, oval, pyramidal, parallelogram, and/or the like), configured to be received inside a cavity 216 have that same connection shape.

Continuing from the connector(s) 218, the second extrusion 220 of the male jamb portion 202 may extend outwardly from the male jamb portion 202 at a substantially perpendicular angle parallel to the first extrusion 210. The second extrusion 220 may similarly include an inner extrusion wall 222 and an outer extrusion wall 224. The second extrusion 220 may include one or more small rib-like crevices on inner surfaces of the outer extrusion wall 224 and the inner extrusion wall 222. These crevices may be designed to secure one or more gaskets, e.g., a male gasket as discussed below, in place. The inner extrusion wall 222 may be positioned opposite the outer extrusion wall 224.

One or more cavities 226 may be disposed on the inner extrusion wall 222. Each cavity 226 may be configured to receive a connector 218 that links the second extrusion 220 to the first extrusion 210. Each connector 218 may help maintain the male jamb portion 202 as one single continuous piece. In some embodiments, the male jamb portion 202 may include one frame piece and/or multiple frame pieces. The connector 218 may create a flexible joint type by their substantially dovetail joint structure at either end while providing a seal against water, wind, and/or other weather elements. In other embodiments, the joint of the connector 218 may be of a different shape (e.g., circular, oval, pyramidal, parallelogram, and/or the like), configured to be received inside a cavity 226 have that same connection shape.

From the second extrusion 220 of the male jamb portion 202, the frame of the male jamb portion 202 may include another extrusion 228 in one embodiment that extends proximally to the second corner of the male jamb portion 202. This extrusion 228 may allow for snap-fit joints to hold another mechanism rigidly in place such as that featured by elements 206, 208, and/or 230. In this manner, the extrusion 228 may be configured to be received in and/or secured to the female jamb portion 204.

The female jamb portion 204 may include a rigid frame comprised of a hook-like cavity 230 into which the male jamb tip 206 may be received. The hook-like cavity 230 may be designed in such a way that a portion of the cavity may apply pressure against the male tip 206 as it slides inside the hook-like cavity 230 to maintain the connection. A plurality of dimples 208 disposed on the male tip 208 may aid in a frictional interlocking inside the female hook-like cavity 230. The hook-like cavity 230 may further allow for expansion and contraction of the frame with changing weather conditions. This allowance may be facilitated by the depth of the hook-like cavity 230 and/or the forces exerted on the tip 206 as it slides into the cavity 230, thereby engaging dimples 208 on the inside portion of the male tip 206. It will be understood that other connection mechanisms may be used in addition to or in place of the tips 206 and hook-like cavities 230 for connecting, aligning, and/or stabilizing a male jamb portion 202 with respect to a female jamb portion 204.

The female jamb portion 204 may include a first extrusion 232 that may be comprised of the same rigid material as the rest of the female jamb portion's 204 outer frame. In some embodiments, the first extrusion 232 may extend outwardly toward the male jamb portion 202 at a substantially perpendicular angle to the outer frame of the female jamb portion 204. The first extrusion 232 may include an outer extrusion wall 234 and an inner extrusion wall 236. The first extrusion 232 may include one or more small rib-like crevices on inner surfaces of the outer extrusion wall 234 and the inner extrusion wall 236. These crevices may be designed to secure one or more gaskets, e.g., a female gasket as discussed below, in place. The inner extrusion wall 236 may be positioned opposite the outer extrusion wall 234.

One or more cavities 238 may be disposed on the inner extrusion wall 236. Each cavity 238 may be configured to receive a connector 240 that links the first extrusion 232 to a second extrusion 242 extending outwardly from the male jamb portion 202. Each connector 240 may help maintain the female jamb portion 204 as one single continuous piece. In some embodiments, the female jamb portion 204 may include one frame piece and/or multiple frame pieces. The connector 240 may create a flexible joint type by their substantially dovetail joint structure at either end while providing a seal against water, wind, and/or other weather elements. In other embodiments, the joint of the connector 240 may be of a different shape (e.g., circular, oval, pyramidal, parallelogram, and/or the like), configured to be received inside a cavity 238 have that same connection shape.

Continuing from the connector(s) 240, the second extrusion 242 of the female jamb portion 204 may extend outwardly from the female jamb portion 204 at a substantially perpendicular angle parallel to the first extrusion 232. The second extrusion 242 may similarly include an inner extrusion wall 244 and an outer extrusion wall 246. The second extrusion 220 may include one or more small rib-like crevices on inner surfaces of the outer extrusion wall 246 and the inner extrusion wall 244. These crevices may be designed to secure one or more gaskets, e.g., a female gasket as discussed below, in place. The inner extrusion wall 244 may be positioned opposite the outer extrusion wall 246.

One or more cavities 248 may be disposed on an outer surface of the inner extrusion wall 244. Each cavity 248 may be configured to receive a connector 240 that links the second extrusion 242 to the first extrusion 232. Each connector 240 may help maintain the female jamb portion 204 as one single continuous piece. In some embodiments, the female jamb portion 204 may include one frame piece and/or multiple frame pieces. The connector 240 may create a flexible joint type by their substantially dovetail joint structure at either end while providing a seal against water, wind, and/or other weather elements. In other embodiments, the joint of the connector 240 may be of a different shape (e.g., circular, oval, pyramidal, parallelogram, and/or the like), configured to be received inside a cavity 248 have that same connection shape.

Each extrusion 210, 220, 232, 242 described for the male jamb portion 202 and the female jamb portion 204 may be manufactured from a derivative of an aluminum based alloy in one embodiment (or could be made up of a range of other alloys whose major component could be copper, zinc, tin, iron, nickel, gold, and/or the like), a synthetic polymers in other embodiments (e.g., high-density polyethylene, low density polyethylene, polypropylene, polyvinyl chloride, polystyrene, polyethylene terephthalate, and/or the like), or fiberglass in a different embodiment. Extrusions 210, 220 may extend vertically along the length of the male jamb portion 202, whereas extrusions 232, 242 may extend vertically along the length of the female jamb portion 204.

Figure 2B:
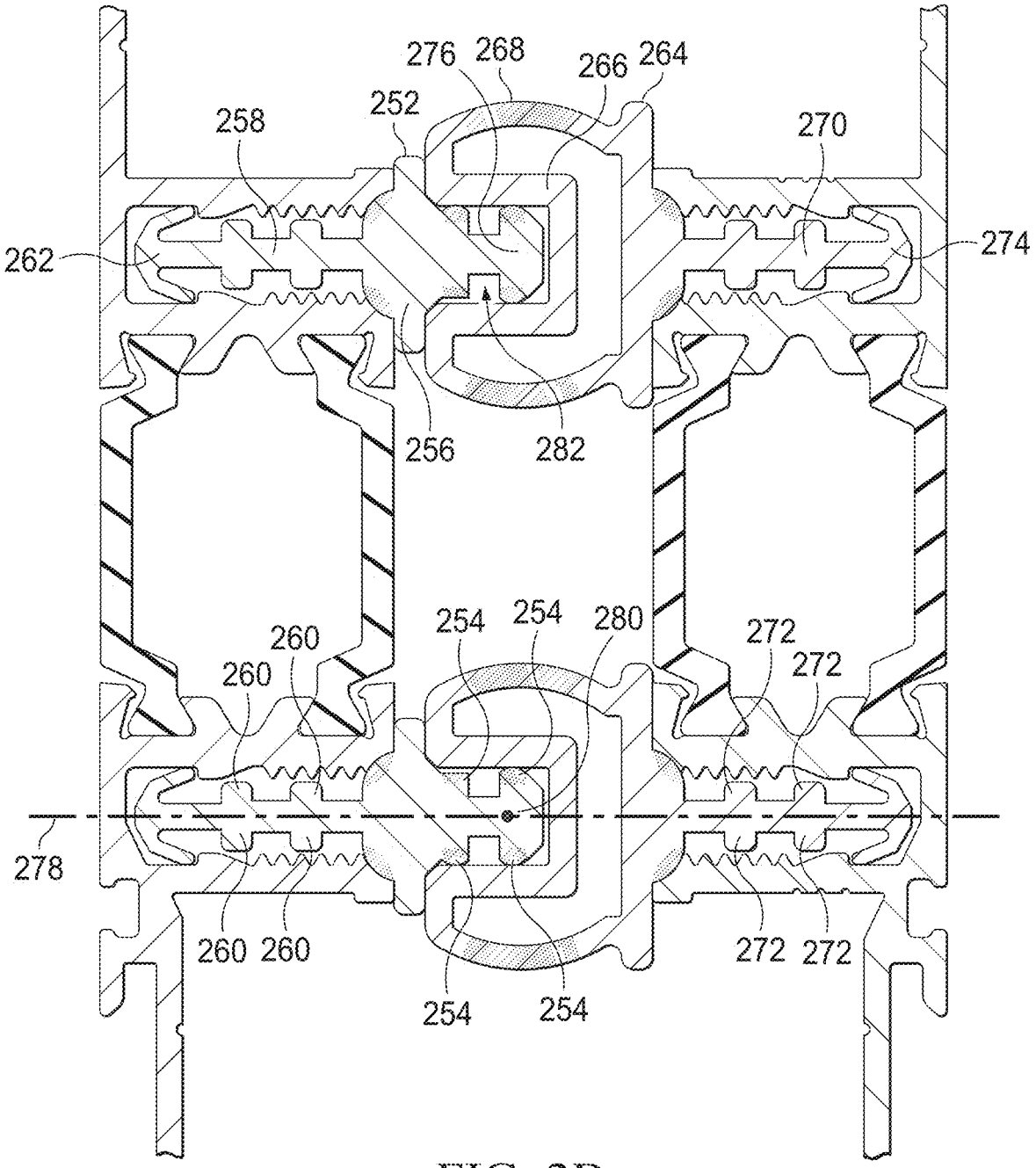
FIG. 2B illustrates a male and female gasket connection, in accordance with some embodiments of the disclosure.

FIG. 2B may illustrate vertical male and female gaskets used to create seals between adjacent window frames. In some embodiments, the extrusions 210, 220 of the male jamb portion 202 may each be configured to receive and/or secure a male gasket 252. In some embodiments, the extrusions 232, 242 of the female jamb portion 204 may each be configured to receive and/or secure a female gasket 264. The male gasket 252 may extend vertically along the length of the male jamb portion 202, whereas the female gasket 264 may extend vertically along the length of the female jamb portion 204.

Each gasket 252, 264 may be comprised of two types of materials, e.g., a soft rubber and a hard plastic. For example, a hard plastic may comprise the core of the gaskets 252, 264, while a soft rubber may be limited to an outer contour of the gaskets 252, 264. The plastics that comprise the gaskets 252, 264 may be synthesized from a range of synthetic polymers not limited to high-density polyethylene, polystyrene, or polyethylene terephthalate. The soft rubber may serve as a functional seal between the male gasket 252 and the female gasket 264.

At a first end of the male gasket 252, there may be one or more soft rubber seals 254 extending outwardly from the male gasket 252 so as to make contact with inside walls of the female gasket 264 (discussed subsequently). The soft rubber seals 254 may extend outwardly from a head portion of the male gasket 252. The head portion may provide a seal 256 extending outwardly from the male gasket 252. The seal 256 may interface with a surface of the female gasket 264. A second end and/or a tail portion 258 of the male gasket 252 may be received inside the first extrusion 210 of the male jamb portion 202, thus securing the male gasket 252 to the male jamb portion 202. The tail portion may be made of hard plastic. The tail portion 258 of the male gasket 252 may include a plurality of ribs 260 disposed on its outer surface, where the ribs 260 engage an inner surface of the first extrusion 210. The tail portion 258 may include an anchor 262 at the second end that secures the male gasket 252 inside the first extrusion 210 of the male jamb portion 202. The ribs 260 protruding from the tail portion 258 of the male gasket 252 may be designed to engage and/or frictionally interlock with inner surfaces of the first extrusion 210. Characteristic to the extrusions 210, 220 and as described above, the ribbed inside walls of the extrusions 210, 220 may facilitate an interlocking mechanism that helps maintain the male gasket 252 inside the male jamb connection 202 and, in turn, inside the female gasket, 264. A connection may be maintained by interlocking and/or frictional forces as the ribbed tail portion 258 of the male gasket 252 engages with the inner surfaces of the first extrusion 210 of the male jamb portion 202. The inside of the first extrusion 210 of the male jamb connection may also have a snap-fit joint that secures the anchor 262 in place by securing arched tips of the anchor 262. In this way, male gaskets 252 may be secured to the male jamb portion 202. Male gaskets 252 may be operatively coupled to both the first and second extrusions 210, 220 of the male jamb portion 202 in this manner.

Female gaskets 264 may also be operatively coupled to first and second extrusions 232, 242 of the female jamb portion 204 in the same manner as described below.

Each of the first and second extrusions 232, 234 of the female jamb portion 204 may be configured to receive and/or operatively couple to a female gasket 264. The female gasket 264 may be comprised of one or more types of materials, for example a flexible rubber and a hard plastic. These materials may be synthesized from a range of synthetic polymers not limited to high-density polyethylene, polystyrene, or polyethylene terephthalate. The combination of such materials may be designed to optimize the sealing capabilities of the female gasket 264.

The female gasket 264 may include an inner portion 266 and an outer portion 268. The outer portion 268 of the female gasket 264 may be non-rigid, for example being made with a flexible rubber. The outer portion 268 may be designed to absorb movements between adjacent window frames (and thus movements between the male gasket 252 and the female gasket 264). For example, the male-and-female gasket connection described herein may be enabled to maintain a seal between adjacent window frames even as the adjacent window frames expand and contract with respect to one other during various weather or temperature conditions. The seal may further be maintained by the choice of material for the inner portion 266 and outer portion 268 of the female gasket 264, as the chosen materials may contribute to shape malleability with changing weather conditions.

In some embodiments, the female gasket 264 (e.g., the outer and/or inner portions 268, 266) may be enabled to collapse on itself in warm weather and still maintain a seal. For example, when adjacent window frames (e.g., window frame 100) expand with respect to one other, the male and female jamb portions 202, 204 may be urged toward each other. In this instance, a seal may be maintained by the female gasket 264 collapsing against a surface of the seal 256 provided by the male gasket 252. The collapse of the female gasket 264 may achieve the seal by applying pressure on soft rubber ends of the seal 256 that protrudes outwardly from the head of the male gasket 252. Said differently, the curvature of the outer portion 268 of the female gasket 264, which may be comprised of soft rubber in one embodiment, may collapse without losing the seal between the female gasket 264 and the soft rubber portions of the seal 256 that extends from the head of the male gasket 252. In another embodiment where the inner portion 266 of the female gasket 264 is also comprised of soft rubber, the curvature of the outer portion 268 of the female gasket 264 may facilitate the collapse of the inner portion 266 of the female gasket 264 as well. As the female gasket 264 collapses, the inner portion 266 may apply a multidirectional force of pressure on soft rubber portions 254 that extend from the head of the male gasket 252, thereby maintaining the seal between the male and female gaskets 252, 264. The female gasket 264 may be designed to withstand changes in shape. Because of the strength of such a design, the shape and/or integrity of the female gasket 264 may not be lost forever after each collapse. Instead, the shape may be recovered as the temperature increase returns to a resting temperature.

In some embodiments, the inner portion 266 of the female gasket 264 may include a cavity 282 into which the male gasket 252 is received. The first end of the male gasket 252 may include one or more outwardly-extending extrusions 254 that engage the inner portion 266 of the female gasket 264 when inserted within the cavity 282. The male gasket 252 may slide into an interior of the female gasket 264.

When weather gets cool, adjacent window frames (e.g., window frame 100) may contract so as to urge the female gasket 264 away from the male gasket 252. The gasket connection described herein may still maintain a seal between the extruding seals 254 of the male gasket 252 and the inner portion 266 of the female gasket 264. In this manner, the male gasket 252 may apply forces outwardly against inner surfaces of the female gasket 264, even if one or more of the extruding seals 254 are removed from the interior of the female gasket 264 during contraction.

Similar to how the male gaskets 252 couple to the extrusions 210, 220 of the male jamb portion 202, the female gaskets 264 may couple to the extrusions 232, 242 of the female jamb portion 204.

A tail portion 270 of the female gasket 264 may be received inside the first extrusion 232 of the female jamb portion 204, thus securing the female gasket 264 to the female jamb portion 204. The tail portion 270 may be made of hard plastic. The tail portion 270 of the female gasket 264 may include one or more ribs 272 disposed on its outer surface, where the ribs 272 engage an inner surface of the first extrusion 232. The tail portion 270 may include an anchor 262742 at a second end that secures the female gasket 264 inside the first extrusion 232 of the female jamb portion 204. The ribs 272 protruding from the tail portion 270 of the female gasket 264 may be designed to engage and/or frictionally interlock with inner surfaces of the first extrusion 232. Characteristic to the extrusions 232, 242 and as described above, the ribbed inner walls of the extrusions 232, 242 may facilitate an interlocking mechanism that helps maintain the female gasket 264 inside the female jamb connection 204 and, in turn, coupled to the male gasket 252. A connection may be maintained by interlocking and/or frictional forces as the ribbed tail portion 270 of the female gasket 264 engages with the inner surfaces of the first extrusion 232 of the female jamb portion 204. The inside of the first extrusion 232 of the female jamb portion 204 may also have a snap-fit joint that secures the anchor 274 in place by securing arched tips of the anchor 274. In this way, female gaskets 264 may be secured to the male jamb portion 204. Female gaskets 264 may be operatively coupled to both the first and second extrusions 232, 242 of the female jamb portion 204 in this manner.

In general, the male gasket 252 may slide into the female gasket 264 along at least a portion of the length of a window frame to complete and maintain a seal between two (or several) adjacent window frames. During installation of an adjacent window frame, the male gasket 252 may slide inside the female gasket 264 at one end of the female gasket 264 (e.g., a top end, a bottom end, and/or the like). The male gasket 252 and/or the female gasket 264 may run the full (or partial) length of a vertical window frame jamb to maintain a connection and seal between adjacent window frames.

In some embodiments, the anchor 262 of a male gasket 252 may comprise a distal end or a proximal end of the male gasket 252. In some embodiments, a head portion 254 of a male gasket 252 may comprise a distal end or a proximal end of the male gasket 252. In some embodiments, the anchor 274 of a female gasket 264 may comprise a distal end or a proximal end of the male gasket 274. In some embodiments, an inner portion 266 of a female gasket 264 may comprise a distal end or a proximal end of the female gasket 264. In some embodiments, an inner portion 266 of a female gasket 264 may define a cavity 282, e.g., operable to receive a head portion 254 of a male gasket 252. In some embodiments, a seal (e.g., an airtight seal or a watertight seal) may be formed between a seal portion 256 of a male gasket 252 and one or more surfaces of a female gasket 264.

Temperature fluctuations may vary the position and/or size of the male gasket 252 and/or the female gasket 264. A variance in temperature may cause an interface or seal between the male gasket 252 and the female gasket 264 (e.g., between a seal portion 256 and an end of a female gasket 264) to at least temporarily increase in tightness, decrease in tightness, and/or become mechanically decoupled (e.g., such that a seal no longer exists). Ribs 254 of a head portion of a male gasket 252 may be disposed within a cavity 282 of a female gasket 264, such that the ribs 254 of the head portion create a frictional fit (or interference fit) with the inner portion 266 of the female gasket 264 defining the cavity 282. The frictional fit may impede and/or prevent a loss of seal between a male gasket 252 and a female gasket 264 during a temperature fluctuation and/or other mechanical perturbation. For example, a temperature fluctuation could cause at least a slight translational displacement of the male gasket 252 away from the female gasket 264 along an axis substantially aligned with an insertion axis (e.g., horizontal axis 278) of the male gasket 252 into the female gasket 264. A seal 256 of a male gasket 252 may contact a female gasket 264 in a default, resting, and/or installed state. Alternatively or additionally, a seal portion 256 of a male gasket may be used as a mechanical guide to indicate proper insertion length of the male gasket 252 into a female gasket 264 during an installation procedure (e.g., along a horizontal axis 278). Providing more than one gasket pair may enhance an air (e.g., for insulation purposes) and/or contaminant (e.g., for mold purposes) seal. Additional sealing structure may be provided around the gasket pair, such as an overlaid cover, fabric, or diaphragm.

It will be understood that the male and female gaskets 252, 264 may comprise alternative or additional structure in order to provide a seal. For example, a male gasket 252 may comprise a head portion 276 without individually identifiable soft rubber seals 254. During temperature fluctuations, deformation of the gasket pair may or may not break or form a seal. In the case that a seal is broken, other structure may still provide a seal or a substantially insulated interface (e.g., in-filled material such as fiberglass).

An adjacent pair of window frames comprising at least one of a male gasket 252 and a female gasket 264 may be assembled along an axis parallel to a vertical axis 280 and/or along a horizontal axis 278, e.g., diagonally. During assembly and/or installation, one or both gaskets may deform (e.g., elastically deform due to a rubbery material composing at least a portion of the one or both gaskets) in order to facilitate entry of the male gasket 252 into the female gasket 264. For example, a male gasket 252 may be substantially rigid and a female gasket 264 may comprise a flexible material on at least a portion of its outer portion 268 and/or inner portion 266 in order to allow accommodating horizontal movement of the connecting end of the female gasket 264 along a horizontal axis 278.

One or more pairs of gaskets 252, 264 may be used to provide an interlocking and/or seal mechanism between an adjacent pair of window frames. For example, as illustrated in FIGS. 2A and 2B, two pairs of vertically parallel gaskets 252, 264 may be used. Also, as shown in FIGS. 2A and 2B, extrusions 216, 238 and/or connections 218, 240, which may be physically separate and/or integrally formed structures, may be formed or in-filled with material in order to provide additional sealing and/or insulation from temperature changes and/or contaminants.

It will be understood that the locations of the male gasket 252 and female gasket 264 may be interchanged. Similarly, it will be understood that the configuration of the male jamb portion 202 and the female jamb portion 204 may be interchanged. Further, it will be understood that one or more gasket pairs (e.g., a male gasket 252 and a female gasket 264) may be used between adjacent window frames 100. If more than one gasket pair is used, male and female gaskets may be alternated on any order on a given jamb portion. A window frame 100 may not comprise a complementary set of gasket types on each of its jamb portions. For example, a window frame 100 may comprise only male jamb portions and/or male gaskets on each side, thus requiring adjacent window frames 100 to comprise only female jamb portions and/or female gaskets. Alternatively or additionally, the "maleness" or "femaleness" of a gasket may alternate along a vertical direction of a gasket (e.g., a gasket may comprise a top male gasket portion and a bottom female gasket portion).

An assembly may comprise one or more gasket pairs. A gasket pair may refer to a male gasket 252 and a female gasket 264, with or without external structure (e.g., outer extrusion wall 234). Gasket pairs may extend at least partially from the bottom to the top of a window frame 100. Gasket pairs may be oriented vertically, horizontally, and/or at an angle. In some embodiments, gasket pairs may not extend the full vertical distance of a window frame 100, and may be overlapped to provide sealing. In some embodiments, a window assembly may comprise two adjacent window frames 100 with one or two gasket pairs that extend the full vertical height of the window frame 100. An assembly may be rigid or flexible (e.g., along an axis substantially parallel to a vertical axis 280).

After installation and/or assembly of adjacent window frames, disassembly and/or detachment of the adjacent window frames may or may not require breaking at least a portion of the window assembly (e.g., anchor 262, 274). An assembly with more than one gasket pair may or may not require intervening structure such as connectors 218, 240. For example, structural rigidity and/or alignment may alternatively or additionally be provided by other connecting structure, such as the gasket pair(s) themselves, and/or outer connection mechanisms such as a tip 206 and hook-like cavity 230. In some embodiments, connectors 218, 240 may be integrally formed into a window frame jamb. In some embodiments, male and female gaskets 252, 264 may be integrally formed into their respective window frame jambs. It will be understood that a sealing due to a gasket pair may be achieved with alternative or additional structure coupling male and female gaskets 252, 264 to their respective window frame jambs.

Figure 3:
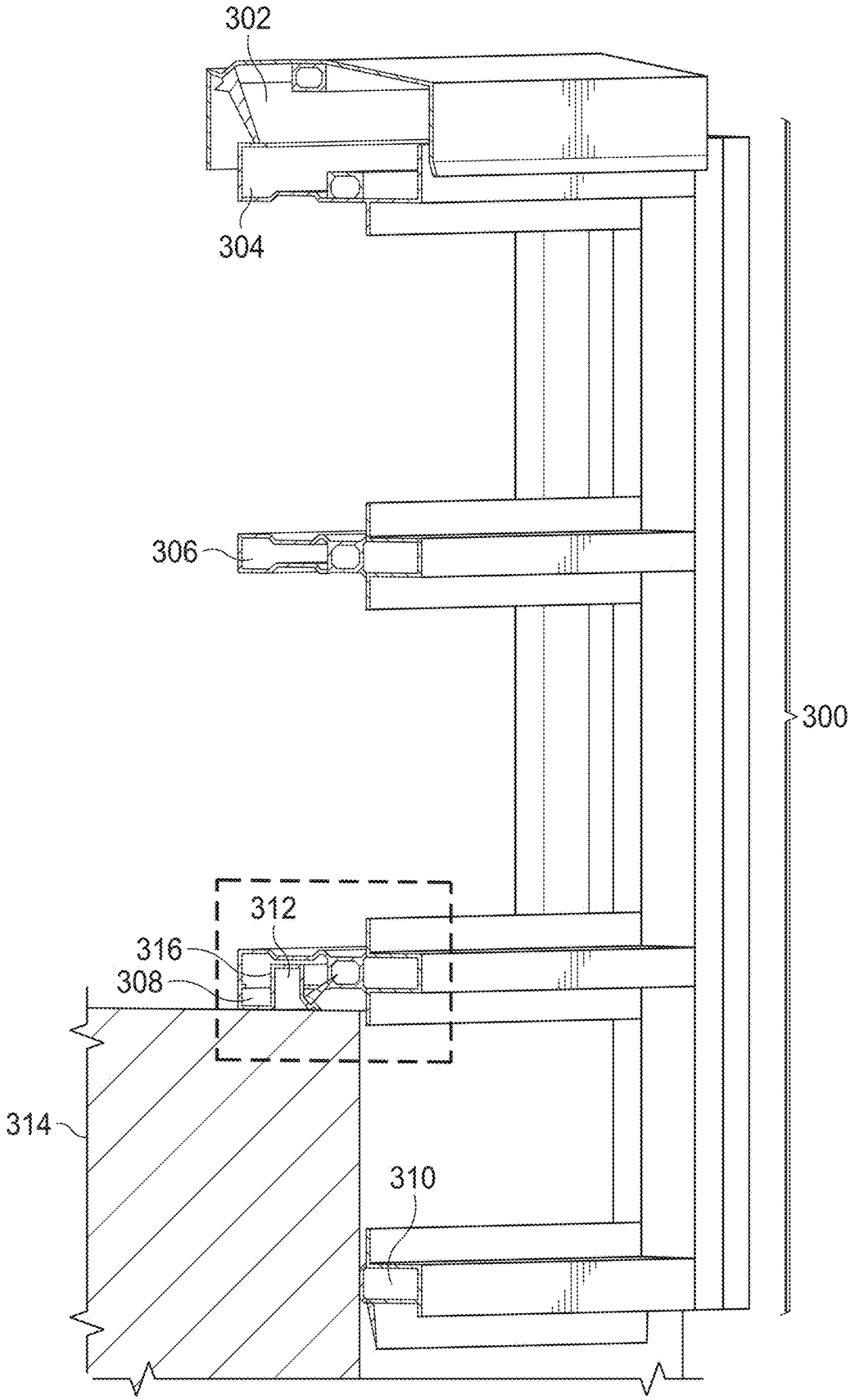
FIG. 3 illustrates a cross-sectional perspective view of a window frame, in accordance with some embodiments of the disclosure.

FIG. 3 may illustrate a cross-section of the perspective view of a window frame 300 (e.g., window frame 100 from FIGS. 1A and 1B). The cross-section may illustrate interior mechanisms included in the window frame 100 as illustrated in FIG. 1B. For example, cross section 300 may illustrate a cross-sectioned header 302 (e.g., header 114), a cross-sectioned fourth window frame rail 304 (e.g., window frame rail 112), a cross-sectioned third window frame rail 306 (e.g., window frame rail 110), a cross-sectioned second window frame rail 308 (e.g., window frame rail 108), and/or a cross-sectioned first window frame rail 310 (e.g., window frame rail 106), which connects at a bottom of the window frame 100 described in some detail above. The sill anchor 128 introduced in the description of FIG. 1B may be part of the structure of the cross-sectioned second window frame rail 308. The cross-sectioned sill anchor 312 (e.g., sill anchor 128), may be included in another window frame rail, depending on the window frame design.

Also visible in this cross-sectioned view may be a mounting surface 314 (e.g., mounting surface 126). The mounting surface may include a slab of concrete 314 (or another surface material previously discussed) on which a window frame sill may rest (e.g., see cross-sectioned window frame sill 316). Here, it is important to highlight that generally, a window frame sill may serve to anchor the window frame to the surface. The sill anchor 128 and its role is discussed in the subsequent paragraphs. Of note, and as will be discussed and shown in the following figures, each element of the sill's outer shell may be important in securing the window frame 100 to the mounting surface 128 below.

Figure 4:
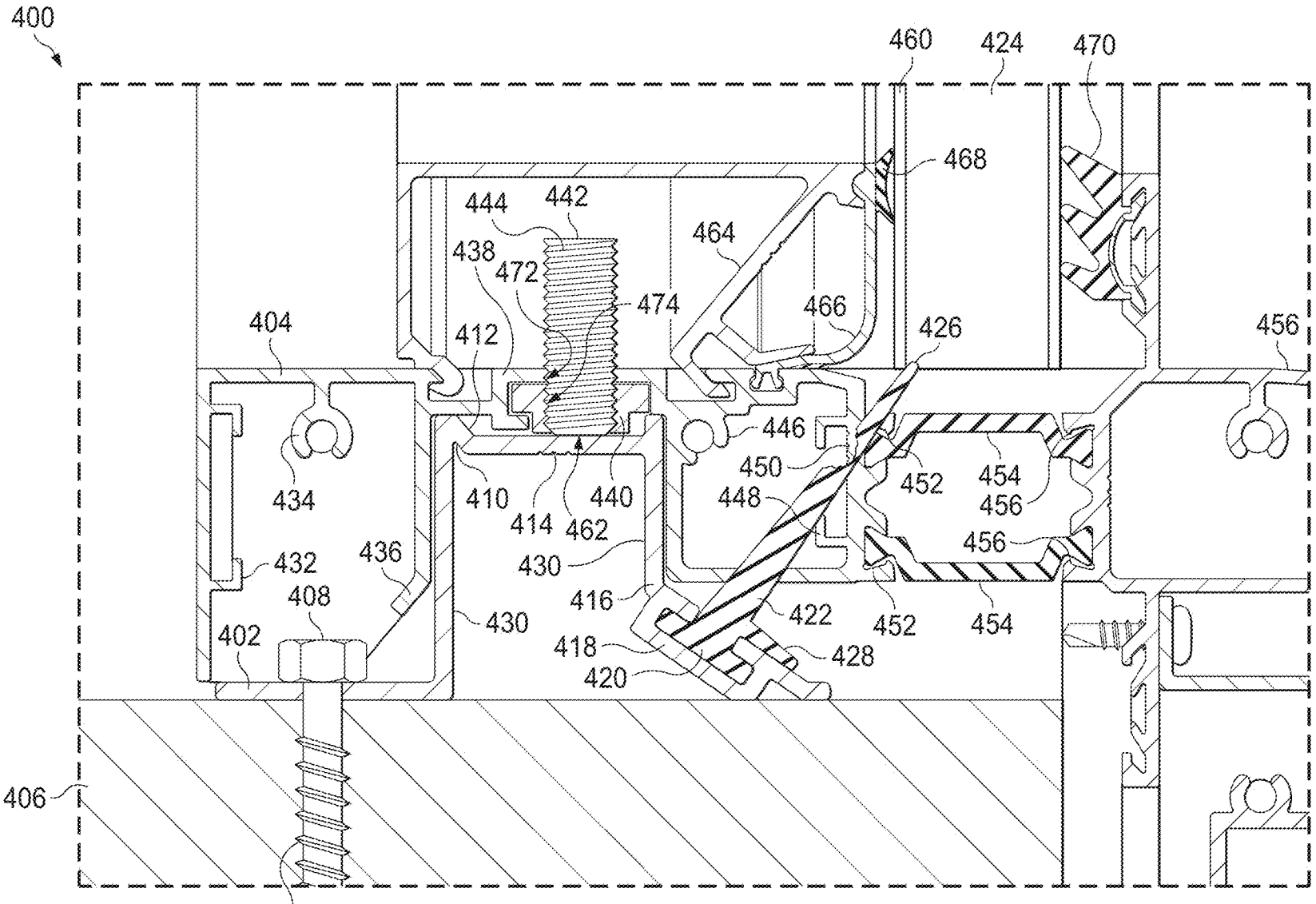
FIG. 4 illustrates a first cross-section view of a window sill and related elements, in accordance with some embodiments of the disclosure.

FIG. 4 illustrates a side cross-section view 400 of a window frame sill, window frame stool, and/or sill anchor (e.g., elements 108, 124, 128, 308, and/or 312). In some embodiments, the window frame stool 124 may include an outer sill frame 402 and an inner sill frame 404. Each of the outer sill frame 402 and the inner sill frame 404 may be manufactured from a derivative of an aluminum based alloy or a range of other alloys whose major component could be copper, zinc, tin, iron, nickel, gold, and/or the like, a synthetic polymer in other embodiments (e.g., high-density polyethylene, low density polyethylene, polypropylene, polyvinyl chloride, polystyrene, polyethylene terephthalate, and/or the like), and/or any other material.

A bottom surface of the outer sill frame 402 may be disposed on and/or operatively couple to a top surface of a mounting surface 406. In some embodiments, a threaded screw 408 may be used to secure the outer sill frame 402 to the mounting surface 406 below. The screw 408 may be threaded with a plurality of rings disposed circumferentially and at an angle 410 to allow the best grip to the mounting surface 406 below. In other embodiments, as an alternative to a standard threaded screw, the outer sill frame 402 may be secured to the surface using one-touch fasteners, self-clinching captive panel screws, pins, shoulder screws, nails, clips, and/or other couplings. The screw 408 may serve to apply a downward force in the direction of the mounting surface 406 to help secure the window frame 100 during installation.

Continuing past the screw 408, the outer sill frame 402 may include an acute angle 410 and/or an obtuse upward bend 412 so as to provide a substantially flat surface for interfacing with a jacking screw 442. The surface for interfacing with the jacking screw 442 may include one or more dimple-like ridges 414 for increasing stability and/or flexibility. The outer sill frame 402 may also include a downward bend 416, forming an obtuse angle, to couple with a sill frame extrusion 418 that is designed to hold a T-shaped sill track seal tail 420 of a sill track seal 422.

The outer sill frame 402 may operatively coupled to the sill track seal 422. In some embodiments, the sill track seal 422 may comprise a rubber gasket that is coupled to the sill track by a T-shaped sill track seal tail 420, where the sill track seal tail 420 is slid into a side of the sill frame extrusion 418 during installation. In other embodiments, the sill track seal tail 420 may take several other shapes. For example, rather than a T-shape, the sill track seal 422 may be attached to the window frame 100 by a circular and/or oval connector with grooves that may allow for more versatility and mobility across the xyz-plane. Generally, the role of the sill track seal 422 may be to prevent water or wind from entering any space that the window frame 100 is positioned to protect. The sill track seal 422 may create a seal between a bottom or side surface of a window 424 and the sill of the window frame 100. The sill track seal 422 may have a tapered shape that extends towards the position of a window 424 installed within the window frame 100. For example, a base of the sill track seal 422 may be wider than a distal end 426 of the sill track seal 422 that interfaces with a window surface. When the window 424 is installed, the sill track seal 422 may flex or bend such that the distal end 426 is urged and/or displaced downward. The distal end 426 of the sill track seal 422 may engage a surface of the window 424 to form a seal.

To ensure a strong seal, the sill track seal 422 may also include a tab 428 which provides stability. For example, when the sill track seal 422 is bend downward upon installation of the window 424, the tab 428 may engage a top surface of the extrusion 418 so as to provide upward force through the sill track seal 422 and therefore against the surface of the window 424. Additionally, the tab 428, the extrusion 418, and/or another surface of the sill track seal 422 and/or the outer sill frame 402 may be configured to receive Blueskin and/or another membrane-like film configured to provide a barrier against moisture, water, wind, and/or other elements potentially harmful to the mounting surface 406. Blueskin may include an adhesive sheet that serves as a waterproof foundation membrane and helps to seal adjacent surfaces. In another embodiment, Blue Seal could be used. Blue Seal may be a liquid applied and water-based, which allows it to cover more surface area than an adhesive sheet. Blue Seal may combine the features of a sealer and an elastomer waterproofing membrane and may be based on a Environmental Technology Verification (ETV) copolymer rubber. Blue Seal may effectively waterproof concrete, polystyrene insulation board, foam insulation, wood, and other common surfaces. The tab 428 to which the Blueskin can adhere to may be an outward extension of the sill track seal 422 and may exist in other embodiments of the sill track seal 422 as described above.

In some embodiments, the extrusion 418 may include an aperture through which a coupling is inserted for coupling with the underlying mounting surface 406. This coupling may secure the window frame 100 to the mounting surface 406.

The sill track seal 422 may also be referred to as a window sill seal gasket. The sill track seal 422 may at least partially comprise a rigid material (e.g., hard plastic) and/or may at least partially comprise a non-rigid material (e.g., rubber). The sill track seal 422 may comprise a base portion and a protrusion portion extending towards the base of a window pane (e.g., a glass panel inserted in a window pane opening 424). The protrusion portion may in turn comprise a proximal end near the base portion and a tip near and/or operable to contact a window pane.

During assembly, the sill track seal 422 may be coupled to an outer sill frame 402 (and/or an extrusion 418 thereof), and then a window 424 may be inserted in the window frame 100. A base of the window 424 may make physical contact with the distal end 426 of the sill track seal 422, which may cause at least a portion of the sill track seal 422 to be deflected or flexed (which can also be referred to as "engaged") in order to accommodate the position of and/or physical space occupied by the window 424. The deflected, flexed, displaced, and/or engaged sill track seal 422 may form a seal at the point of contact with the window pane. The sill track seal 422 may form a seal on the bottom of a window pane, on another side of the window pane (e.g., the side or top of a window pane), and/or on another portion of window frame structure (e.g., a window panel 460, such as an aluminum sandwich panel). The portion of a window sill seal gasket 422 making physical contact with a window structural component (e.g., window pane) can depend on the configuration of the window sill seal gasket 422 with respect to the window structural component (e.g., a bottom of the window sill seal gasket 422 may form a seal with a top of a window pane). A window sill seal gasket 422 may form a seal along at least a partial portion of window frame 100 and/or the window 424. For example a window sill seal gasket 422 could be disposed along the entire length of the base of a window pane, or multiple adjacent and/or overlapping sill track seals 422 could be positioned against the base of a window pane. Adhesive and/or one or more structural connection mechanisms may be provided at the point of physical contact between a window sill seal gasket 422 and a structural component of the window 424 (e.g., a window pane). For example, adhesive or a sealing agent (e.g., a viscous liquid) may be applied to the contacting portion of the sill track seal 422 and/or a rear surface 460 of a window panel, the window 424, a window pane, and/or the like.

A seal between the sill track seal 422 and a structural component of the window 424 may be formed by countervailing forces between the sill track seal 422 and the structural component for a window. For example, the sill track seal 422 could be buttressed by additional structure within and/or apart from the window frame 100. As illustrated in FIG. 4, an outer sill frame extrusion 418 may include a cavity operable to receive a sill track seal tail 420 of the sill track seal 422. The sill track seal tail 420 of the sill track seal 422 may be slid into the cavity from the side and/or temporarily flexed and inserted from the top of the cavity (e.g., if the sill track seal tail 420 comprises an at least partially non-rigid material, such as rubber). The cavity may comprise a track, and the track may be substantially parallel to a side of the window 424. The cavity and/or track may comprise or be used with additional structure to align the sill track seal 422 (e.g., a "stopper" at one or more locations to keep the sill track seal 422 horizontally in place during installation and/or operation). Alternatively or in addition to insertion into a cavity of an outer sill frame extrusion 418, the sill track seal 422 may be structurally supported by other means, such as adhesive (e.g., disposed within the cavity and/or on a contact interface between the sill track seal 422 and/or outer sill frame extrusion 418), latching mechanisms, interference fits, hooks, and/or mating of complementarily-shaped portions.

In some embodiments, the sill track seal tail 420 and/or tab 428 of the sill track seal 422 may be referred to as "feet" (e.g., "first foot" and "second foot," respectively). In some embodiments, the sill track seal 422 may be connected to a window sill frame 100 or supporting structure providing a countervailing force via alternative or additional mechanisms. In some embodiments, the sill track seal 422 may be integrally formed into the window frame 100 and/or an outer sill frame 402.

In some embodiments, the protrusion of the sill track seal 422 may be wider near at its base than at its tip, e.g., as illustrated in FIG. 4. This graduation of cross-sectional width may also be referred to as tapering, which may provide advantageous support and/or structural robustness to the sill track seal 422. In some embodiments, the tip of the distal end 426 or other portion of the sill track seal 422 intended to contact a structural component of the window 424 (e.g., window pane) may comprise various shapes such as a circular cross-section, "cupped" cross-section, curved profile, straight profile, and/or enlarged profile. The geometry and/or cross-sectional profile of the sill track seal 422 may affect the amount of contact, angle of contact, and/or strength of seal. For example, the sill track seal 422 being disposed at a more shallow angle (e.g., 30 degrees) may contact a greater portion of the base of a window pane than if the sill track seal 422 is disposed at a steeper angle (e.g., 60 degrees). The angle and/or length of the sill track seal 422 may depend on structural constraints, manufacturing constraints, cost, assembly constraints, ease of installation, aesthetics, desired amount of seal contact portion, and/or desired seal strength. In some embodiments, the sill track seal 422 may be integrally formed as one piece (e.g., with uniform or non-uniform material makeup), e.g., by a single extrusion process. In other embodiments, each element of the sill track seal 422 may be physically distinct and assembled prior to installation into a window frame and/or outer sill frame 402, or during installation.

In this manner, the sill track seal 422 may provide sealing (e.g., against liquid and/or contaminant ingress), insulation (e.g., to prevent loss and/or entry of heat), and/or structural support (e.g., to a window pane resting thereon). The sealing, insulation, and/or structural support functionality of a window sill seal gasket may be used in conjunction with other sealing (e.g., other gaskets), insulation (e.g., fiberglass filler), and/or structural components (e.g., window panels 460) within or apart from a window frame 100 or outer sill frame 402, and may be necessary or merely a safeguard for desired operation. Collectively, the portions of the outer sill frame 402 may be referred to as a sill anchor 430.

The inner sill frame 404 may include a vertical portion that is independent of the outer sill frame 402. The vertical portion may include a rectangular extrusion 432 and/or a round extrusion 434 that secures the inner sill frame 404 and allows for pivotal rotation. The inner sill frame 404 may also include an indented tip 436 in this embodiment. In other embodiments the tip 436 may not be indented or may extend further.

In some embodiments, the inner sill frame 404 may include an extrusion 438 designed to house a nut 440. This extrusion 438 of the inner sill frame 404 may be positioned directly above the upper portion of the sill anchor 430. In some embodiments, the nut 440 may be integrated into the inner sill frame 404.

The extrusion 438 may include an aperture (e.g., a drilled hole) to allow for the jacking screw 442 to be threaded through the nut 440 and/or otherwise received through the inner sill frame 404. The jacking screw 442 may be threaded with a plurality of rings disposed circumferentially and at an angle 444, in some embodiments, to allow optimal threading through the nut 440. As the jacking screw 442 is tightened through the nut 440, the jacking screw 442 may make contact and/or engage with a top surface of the sill anchor 430 and/or the outer sill frame 402 below, displacing the inner sill frame 404 upward. Exerting pressure on the top portion of the sill anchor 430 and/or outer sill frame 402 may cause a rear end of the inner sill frame 404 to rise with respect to the outer sill frame 402. Raising and/or lowering the rear end of the inner sill frame 404 (and thus the window 424) with respect to the outer sill frame 402 may enable a user to align the window 424 to a desired angle and/or height (e.g., vertically). The jacking screw 442 may make leveling and aligning windows easier and more efficient than existing methods. Particularly, with the use of the jacking screw 442, windows may be installed on any mounting surface, regardless of undesirable undulations that may make the surface uneven and which may complicate window installation.

The inner sill frame 404 may further include a circular extrusion 446 to secure in inner frame 404 to adjacent elements. Opposite the circular extrusion 446 may be a rectangular extrusion 448 that features one or more dimple-like ridges 450 in this embodiment. An outer front surface of the inner sill frame 404 may include one or more dovetail extrusions 452 that house respective connectors 454. The connectors 454 may link the inner sill frame 402 to a second portion 456 of the window frame 100 (e.g., window frame stool 124), perhaps closest to the window frame apron 122. The second portion 456 may also include one or more dovetail extrusions 452 positioned on an outside surface for receiving the connectors 454. The connectors 454 may be flexible so as to allow movement of the inner sill frame 404 with respect to the outer sill frame 402 caused by adjusting the jacking screw 442 while still maintaining a seal and/or coupling between elements of the window frame 100. The second portion 456 may be substantially vertical and/or continuous, extending down into the window frame apron 122 and upward to a portion of the window frame stool 124 that couples with a compression gasket 470 discussed below. Of note, in other embodiments, the joints of the connectors 454 may be of a different shape (e.g., circular, oval, pyramidal, parallelogram, and/or the like).

In some embodiments, the jacking screw 442 may a comprise a threaded shaft or other mechanism operable to vertically raise or lower the inner sill frame 404 with respect to the outer sill frame 402. The outer sill frame 402 may be coupled and/or mounted to the mounting surface 406 (e.g., a concrete foundation), via the screw 410 threaded through an aperture of the outer sill frame 402. A window pane (e.g., a glass panel operable such as the window 424) may be directly and/or indirectly mechanically coupled to an inner sill frame 404. When a jacking screw 442 is adjusted, the inner sill frame 404 may move upward or downward relative to the outer sill frame 402, thereby causing the window 424 to be vertically heightened and/or tilted. It will be understood that the general mechanism of adjusting and/or tilting the window 424 in this manner supporting may be implemented in other ways, such as using a ratcheting mechanism, a hydraulic arm, a pivoting mechanism, and/or another coupling.

A jacking screw 442 and/or similar structure may be inserted through a second aperture 472 of the inner sill frame 404 and/or the extrusion 438 thereof. For example, the second aperture 472 may be threaded. The jacking screw 442 may be further inserted into and/or through a third aperture 474, e.g., that of a nut 440. The jacking screw 442 may thus operatively couple with the inner sill frame 404. At least one of the second aperture 472 and third aperture 474 may comprise threads or complementary ratcheting structure for adjusting the jacking screw 442. A bottom surface 462 of the jacking screw 442 may engage a top surface of the outer sill frame 402 and/or sill anchor 430. The jacking screw 442 may be tightened and/or loosened by a tool (e.g., a hex wrench, a socket wrench, a screwdriver, a hex key, a star key, and/or another special purpose connector) and/or manually (e.g., using a knob provided on a head portion of a jacking screw 442).

The nut 440 may or may not be necessary to provide the vertical adjustment and/or tilting functionality of the jacking screw 442 mechanism. For example, in lieu of using an nut 440, the extrusion 438 simply may be threaded. A nut may comprise internal threads of a substantially complementary profile and/or angle 444 of the jacking screw 442. The jacking screw 442 may be rotated with respect to a vertical axis substantially aligned with the nut 440. As described in more detail below, the window 424 may engage one or more of a compression gasket 470, a heel sill gasket 468, and a sill track seal 422.

Figure 5:
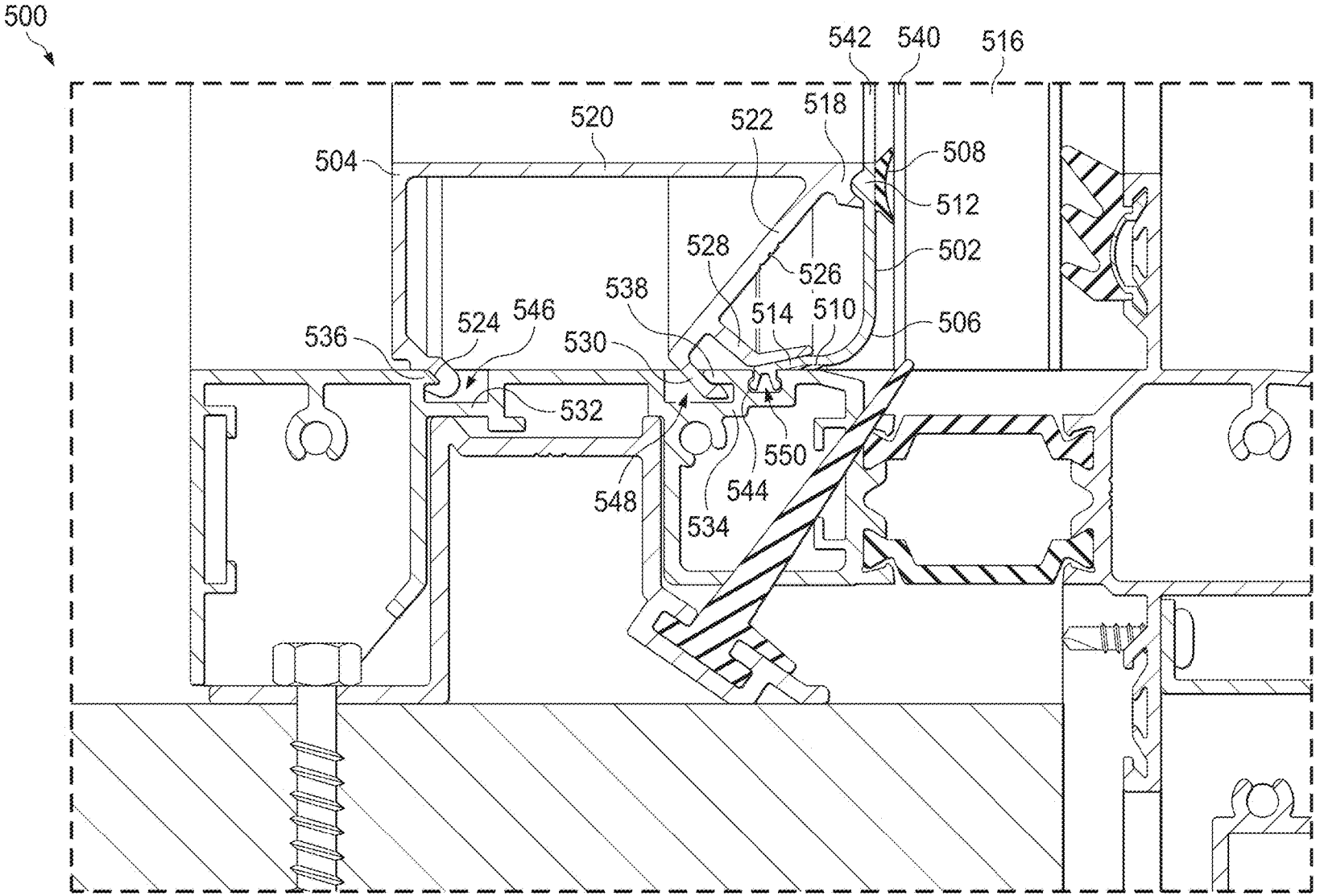
FIG. 5 illustrates a second cross-section view of a window sill and related elements, in accordance with some embodiments of the disclosure.

FIG. 5 may illustrate a side cross-section view 500 similar to that of FIG. 4, but with reference to other elements not yet described. The window frame 100 may include a heel bead gasket 502 with a glass stop 504. Each of the heel bead gasket 502 and the glass stop 504 may be operatively coupled to the inner sill frame 404.

The heel bead gasket 502 may be comprised of a hard plastic portion 506 and a first and a second soft rubber portions (508 and 510 respectively). The hard plastic portion 506 of the heel bead gasket 502 may have the shape of a half-U, which may be advantageous for flexibility and absorption of pressure applied to the glass, or other material, once the glass is installed. The hard plastic portion 506 of the heel bead gasket 502 may be coextruded with the first soft rubber portion 508, and/or coextruded at a head 512 of the heel bead gasket 502. The second soft rubber component 510, a soft rubber pad, may be coextruded at a heel 514 of the heel bead gasket 502.

The first soft rubber portion 508 may be cup-shaped and configured to engage a surface of the window 516 (e.g., window 424) so as to provide a seal between the window 516 and an interior space above the inner sill frame 404. The first soft rubber portion 508 may be operatively coupled to a front surface of the heel bead gasket 502. Again, the first soft rubber portion 508 and the heel bead gasket 502 may be manufactured from one piece or may include multiple separate pieces coupled together.

The second soft rubber pad 510 may engage a top surface of the inner sill frame 404 so as to provide a seal between a cavity into which the window 516 is received and the window frame 100. The second soft rubber portion 510 may be operatively coupled to a bottom and/or side surface of the heel bead gasket 502. Again, the second soft rubber portion 510 and the heel bead gasket 502 may be manufactured from one piece or may include multiple separate pieces coupled together.

The glass stop 504 may be positioned behind the heel bead gasket 502 so that the heal bead gasket 502 is positioned between the glass stop 504 and the window 512. The glass stop 504 may be purposed to support the head 512 of the heel bead gasket 502 and exert a forward force upon a rear surface of the head 512 of the heel bead gasket 502, thereby causing the first soft rubber portion 508 to engage an interior surface of the window 516. The head 512 may include a potentially cup-shaped rear surface made of hard plastic configured to engage a front surface (e.g., groove 518) of the glass stop 504. While other shapes may be contemplated, the shape of the groove 518 may substantially match a contour of the rear surface of the head 512 of the heel bead gasket 502. Exemplary shapes may include a semi-oval, semi-circular, squared edges, rectangular edges, cone shaped, and/or other shape. The shape of the groove 518 and the rear surface of the head 512 may secure one another to each other.

In some embodiments, the glass stop 504 may include two sections, namely a first section 520 and a second section 522. The first section 520 of the glass stop 504 may extend horizontally, whereas the second section 522 of the glass stop 504 may extend diagonally and downward. The first section 520 of the glass stop 504 may operatively couple to the inner sill frame 404. For example, a hook-like protrusion 524 may define an end of the first section 520. The hook-like protrusion 524 may be received within a cavity 546 of the inner sill frame 404 so that at least one surface of the hook-like protrusion engages at least one inner surface of the cavity 546 of the inner sill frame 404. In this manner, the hook-like protrusion 524 may operatively couple the glass stop 504 to the inner sill frame 404.

The second portion 522 of the glass stop 504, may extend diagonally and downwardly from the groove 518. The second portion 522 of the glass stop 504 may comprise one or more dimple-like ridges 526 disposed on a bottom surface. These dimple-like ridges 526 may enable the second portion 522 to bend or flex during installation and/or operation, particularly as various forces are exerted. Continuing from the dimple-like ridges 526 in this embodiment of the glass stop 504, one or more protrusions 528, 530 may extend outwardly and downwardly from the second portion 522 of the glass stop 504. These protrusions 528, 530 may extend substantially parallel to each other. A first protrusion 528 may extend so that its bottom surface engages a top surface of the heel 514 of the heel bead gasket 502. The first protrusion 528 may exert downward force on the heel 514 to ensure that the second soft rubber portion 510 maintains a seal against the inner sill frame 404.

The second protrusion 530 of the second section 522 of the glass stop 504 may extend, similarly to the first protrusion 528, at a substantially right angle from the second section 522. Further, the second protrusion 530 may operatively couple with a top surface of the inner sill frame 404. For example, a top surface of the inner sill frame 404 may include a cavity 548 into which the second protrusion 530 is received. The second protrusion 530 may engage one or more inner surfaces of the cavity 548 to secure the glass stop 504 to the inner sill frame 404.

The glass stop 504 may be snapped into position into a top surface of the inner sill frame 404. The top surface of the inner sill frame 404 may include one or more extrusions, such as a first extrusion 532 and a second extrusion 534. The extrusions 532, 534 may include cavities (e.g., cavities 546, 548, respectively) for receiving one or more portions of the glass stop 504. For example, the first extrusion 532 may include a first extension 536 for engaging an inner surface of the hook-like protrusion 524 of the glass stop 504. Similarly, the second extrusion 534 may include a second extension 538 for engaging a surface of the second protrusion 530 of the glass stop 504.

Once the glass stop 504 is installed, the glass stop 504 may apply pressure on the rear surface of the head 512 of the heel bead seal gasket 502 in a direction toward the window 516. In doing so, the glass stop 504 may also apply pressure so as to cause the first soft rubber pad 508 of the heel bead gasket 502 to engage and/or compress against an inner surface of the window 516, thereby creating a seal. The glass stop 504 may also exert force downwardly via the second portion 522. The downward force may urge the first protrusion 528 toward the heel 514 of the heel bead gasket 502, which then may urge the heel 514 toward the inner sill frame 404. In doing so, the first protrusion 528 may secure the heel 514 against the top surface of the inner sill frame 404. Additionally, this may cause the second soft rubber portion 510 to compress against the top surface of the inner sill frame 404, thereby creating and/or maintaining a seal.

In some embodiments, a first end (e.g., the heel 514) of the heel bead seal gasket 502 may include one or more feet 544 extending outwardly and/or downwardly from the first end. The feet 544 may be operable to be compressed inwardly and inserted into a cavity 550 in a top surface of the second extrusion 534 of the inner sill frame 404. Once inserted, the feet 544 may expand in order to engage at least one inner surface of the cavity 550. An internal profile of the cavity 550 may be contoured to substantially match and/or complement a profile of the feet 544. More generally the feet 544 may engage at least one surface (e.g., a surface of cavity 550) of the window sill frame 100 and/or an extrusion thereof via at least one clip, hook, snap in, interference fit, and/or chemical bonding.

Alternative or additional structure and/or mechanisms may achieve similar seals. For example, one or more ends of the heel seal gasket 502 may be screwed (e.g., with screws, bolts, and/or nuts), chemically bonded (e.g., with adhesive), magnetically coupled (e.g., with magnets attached to each side and/or via use of ferromagnetic materials), and/or coupled in another way to a contacting surface (e.g., a window surface 540, a window panel, a window 516, a second extrusion 534, a window frame 100, and/or the like) in order to form a seal. In some embodiments, the hook-like protrusion 524 may not be necessary for providing sufficient force to form seals. In some embodiments, the glass stop 504 may not be required to hold a heel seal gasket 502 in place, and/or to form a seal between a heel seal gasket 502 and a contacting surface. For example, an overhead panel 542 (and/or a panel beneath, depending on the configuration) may provide a downward (or upward depending on the configuration) force onto the heel seal gasket 502, thus forming a bottom (or top) seal.

Beyond providing a seal, in some embodiments the glass stop 504 and/or the heel seal gasket 502 may provide structural support to a window pane (e.g., a glass pane to be inserted in the window 516) or window surface 540, and/or affect the position and/or orientation thereof (e.g., a glass stop 504 providing a large amount of pressure against a first soft rubber portion 508 may "push out" the contacted portion of the window panel 540 and/or window pane.

In some embodiments, the first and second soft rubber portions 508, 510 may include one or more non-rigid materials and/or rigid materials such as non-compressible materials (e.g., hard plastic). A concave profile of the second soft rubber portion 510 may be advantageous in order to allow the second soft rubber portion 510 to expand or compress as needed in an adaptable manner in order to form an adequate seal. The heel seal gasket 502 may prevent flow of contaminants (e.g., dust, liquid, water) and/or provide insulation (e.g., for heating, cooling, and/or energy efficiency purposes).

Figure 6:
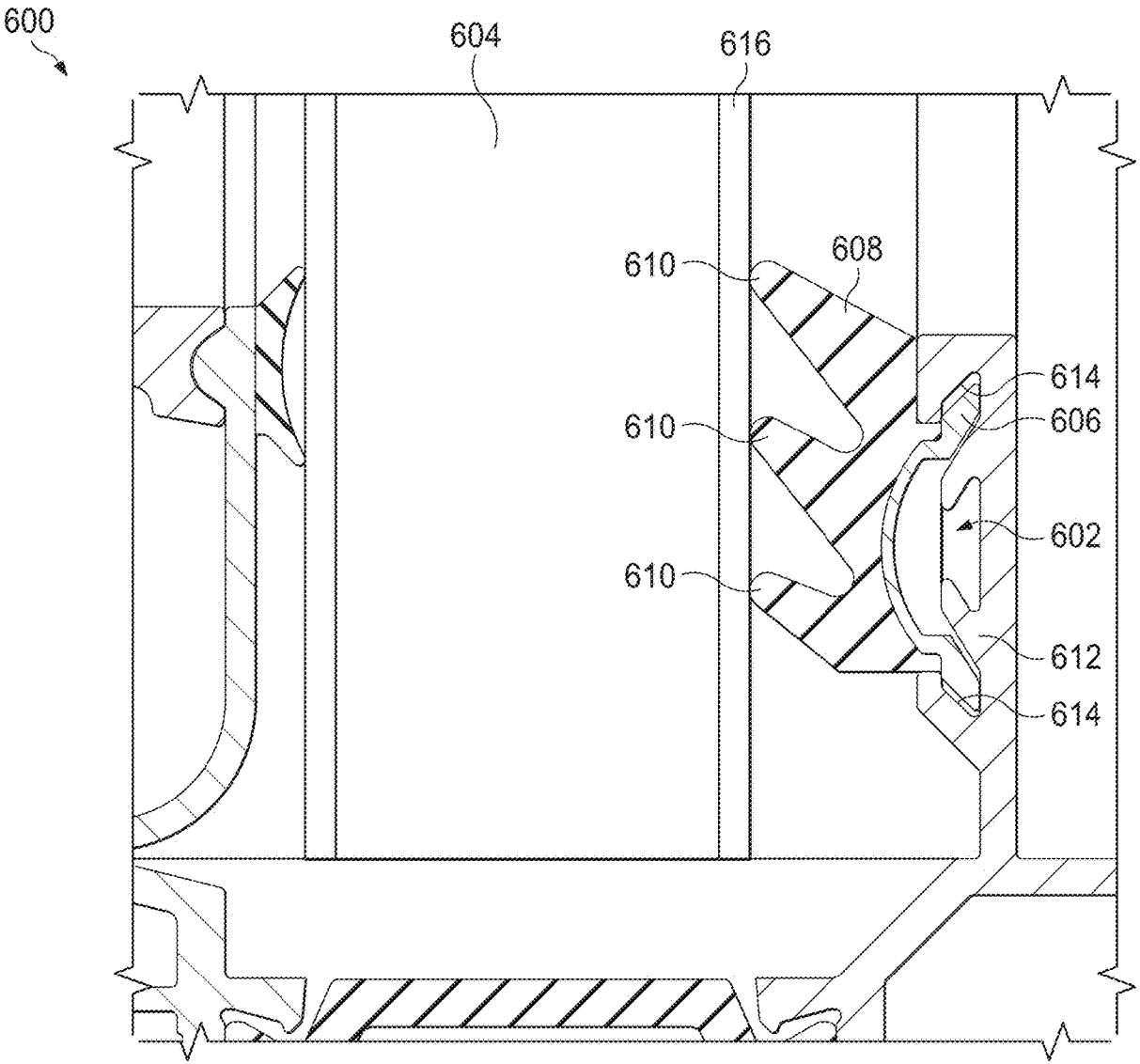
FIG. 6 illustrates a cross-section view of a compression seal for a window, in accordance with some embodiments of the disclosure.

FIG. 6 illustrates a side cross-section view 600 of a compression gasket 602 (e.g., the compression gasket 470 seen in FIG. 4). The compression gasket 602 may be configured to engage an outside (e.g., front) surface 616 of a window 604 so as to provide a seal, keeping water, air, and/or other elements from entering through the window sill 100.

The compression gasket 602 may include a first portion 606 and a second portion 608. In some embodiments, the first portion 606 and the second portion 608 may be manufactured from a common piece or material. In other embodiments, the first portion 606 and the second portion 608 may be manufactured from different materials and/or two pieces coupled together. The first portion 606 may be operatively coupled to the second portion 608. In some embodiments, the first portion 606 and the second portion 608 may be integrally formed and/or comprise a uniform material.

The first portion 606 may include a leaf spring made of hard plastic. Accordingly, the first portion 606 may be at least partially flexible.

The second portion 608 may be made from a non-rigid material such as soft rubber. The second portion 608 may include one or more of finger-like protrusions 610, each being configured to engage the front surface 616 of the window 604. A seal may be created between the front surface 616 of the window 604 and each protrusion 610 of the compression gasket 602. In some embodiments, a front surface 616 of the window 604 may refer to any surface, side, edge, and/or other element of the window 604. Each protrusion 610 may have a unique shape or a common shape. While the shape of each protrusion 610 may be finger-like and/or round in one embodiment 610, these may alternatively be cone-like, star-shaped, and/or another shape.

The second portion 608, perhaps comprised of soft rubber, may be bonded to the first portion 606, which may be made of hard plastic. During a plastic extrusion process, the first and second portions 606, 608 may be melted and/or otherwise combined to form a continuous profile. Creating a single piece using an extrusion process may help create a compression gasket 602 that seals more efficiently against the surface 616 of the window 604 and/or against other elements of the window frame 100.

The compression gasket 602 may operatively couple to an extrusion 612 extending outwardly and/or upwardly from the window frame 100. The extrusion 612 may feature one or more cavities 614 (e.g., dovetail joint openings) into which the first portion 606 of the compression gasket 602 is received. More particularly, each cavity 614 may be operable to receive and/or engage contain end portions (e.g., feet) of the first portion 606. In some embodiments, the feet of the first portion 606 may be shaped similarly to the cavities 614 of the extrusion 612. The feet and/or cavities 614 may form any shape (e.g., dovetail, circular, oval, pyramidal, parallelogram, and/or the like).

When the window 604 is installed into the window frame 100, distal ends of the protrusions 610 of the second portion 608 of the compression seal 602 may engage the surface 616 of the window 604. In doing so, the surface 616 of the window 604 may exert force against the protrusions 610, causing the protrusions 610 to compress in the same direction. In this manner, one or more seals may be created.

Causing the protrusions 610 to compress may also cause the first portion 606 to compress. In some embodiments, when the first portion 606 comprises a leaf spring, compressing the protrusions 610 may also include compressing the leaf spring of the first portion 606. When the leaf spring compresses in the direction of the force being applied from the window surface 616, the leaf spring may expand outwardly within an interior of the extrusion 612. For example, top and bottom surfaces of the first portion 606 may be urged outwardly from each other so as to engage opposite inner surfaces of the extrusion 612. In some embodiments, hard plastic of the first portion 606 may engage the inner surfaces of the extrusion 612. In other embodiments, soft rubber of the first portion 606 and/or the second portion 608 may engage the inner surfaces of the extrusion.

Ends (e.g., feet) of the first portion 606 may also expand outwardly so as to engage one or more inner surfaces of the cavities 614 of the extrusion 612. In this manner, the first portion 606 may ensure that the compression gasket 602 remains secured to the window frame 100.

In some embodiments, the compression gasket 602 may serve as a counter pressure point to the mechanism of the heel bead gasket 502 engaging an opposite (or other) side of the window 604 (e.g., window 424, 516). For example, both gaskets 502, 602 may apply pressure against opposite surfaces 540, 646 of the window 424, 516, 604 to create seals for preventing water, air, and/or other elements from leaking through.

It will be understood that a compression gasket 602 may be operatively coupled to any structural component related to the window frame 100 disclosed herein. Coupling one or more elements described herein may include utilizing a hook, latch, "snap-on" connection, Velcro, mating cavity, screw, bolt, nut, threaded shaft, spring, pin, adhesive, and/or other coupling. In some embodiments, a compression gasket 602 may be integrally formed with a structural component related to the window frame 100. The compression gasket 602 may at least partially comprise a resilient material operable to be to pressed (and therefore at least partially compressed) against a structural component.

A compression gasket 602 and/or second piece 608 may be pressed and/or forced upon a window panel 616 (e.g., due to a countervailing force) in order to prevent air, gas, liquid, contaminants, heat, cold, and/or humidity from permeating across a contact interface between a compression gasket 602 and a window panel 616. Alternatively or additionally, a compression gasket 602 may be operatively coupled to a window 604 and/or a window surface 616 and/or bordering structure thereof. In those embodiments, contact interface made be formed between a compression gasket 602 of the window 604 and a structural component related to the window frame 100.

In some embodiments, the compression gasket 602 may run along at least a portion of a side(s) of the window 604 (e.g., a compression gasket 602 may run along the entire length of the front surface 616 of the window 604). The compression gasket 602 may be straight and/or at least partially curved (e.g., to guide or collect accumulated liquid). The compression gasket 602 may be positioned substantially horizontally with respect to a foundation of a window frame 100, or may be positioned at an angle (e.g., to drain accumulated liquid to one side). A compression gasket 602 may comprise an aperture (not pictured) for draining accumulated liquid. Alternatively or additionally, compression gaskets 602 may be installed and/or positioned so as to provide an aperture (e.g., by spacing adjacent compression gaskets).

Beyond providing sealing and/or insulation, a contact interface between a compression gasket 602 and a structural component related to the window 604 (e.g., a window surface 616) may provide structural "guidance" for positioning and/or orientation purposes. For instance, the compression gasket 602 may push and/or keep the window 604 in place. Structural guidance provided by the compression gasket 602 may work substantially alone or in combination with other structurally guiding features (e.g., other compression gaskets, window frame railings, and/or other elements of the window frame 100).

During installation, the first portion 606 may be snapped into a complementarily-profiled extrusion 612 defining one or more cavities 614. For example, the first portion 606 may at least partially comprise a resilient material such that the first portion 606 can be temporarily bent along a horizontal axis in order to insert feet of the first portion 606 into the cavities 614. The second portion 608 of the compression gasket 602 may be connected to the first portion 606 before and/or after mating the first portion 606 with the extrusion 612. After installation of the compression gasket 602 (including the first portion 606 and the second portion 608) with the extrusion 612, the window 604 may be installed, placed, pressed, and/or forced upon the protrusions 610 of the compression gasket 602 e.g., to form a seal. Alternatively, the window 604 may be positioned and/or installed into the window frame 100 first, and the compression gasket 602 may later be compressed against the window surface 616.

In practice, window frames and/or windows may be used for aesthetics and/or may function as a barrier to the natural elements. Given the flexibility in design and functional breath of a window frame, one or more elements described herein may be utilized in a variety of contexts, including but not limited to commercial buildings, residential buildings, vehicles, steam cars, SUVs, tanks, tractors, aeronautical vehicles, nautical vehicles, boats, ships, containers, tables, all-terrain vehicles, amphibious vehicles, auto rickshaws, cable cars, trolleybus, catamarans, buses, deep submergence vehicles, diving bells, diving chambers, electric vehicles, golf carts, ground effect vehicles, handcars, hoppers, hovercrafts, land yachts, launch escape capsules, locomotives, minibuses, minivans, monorails, passenger cars, race cars, road trains, rockets, rovers, aircraft, screw-propelled vehicles, sea tractors, and/or any other structure or vehicle. Aircraft such as (but not limited to) airships, autogyros, blimps, fixed-wing aircraft, glider aircraft, helicopters, jet aircraft, unmanned aerial vehicles, spacecraft, and/or the like may also benefit from the utilization of embodiments described herein. Other watercraft such as boats, bathyscaphes, yachts, hydrofoils, and/or submarines may also utilize embodiments described herein. Such embodiments may also be utilized in private homes, mobile homes, castles, bungalows, mansions, cottages, condominiums, apartment complexes, manor houses, houseboats, log cabins, villas, yurts, tree homes, farmhouses, duplexes, RVs, shacks, terraced houses, hotels, motels, skyscrapers, restaurants, sports facilities, shopping malls, shops, retail stores, office buildings, serviced offices, industrial warehouses, industrial offices, and/or the like. Similarly, such a window frame design could be used in toy design of each of the vehicles, private homes, and/or commercial buildings outlined above.

Any element described herein may be comprised of any material described herein. Other materials that may be used may be comprised of a variety of synthetic polymers (e.g., high-density polyethylene, low density polyethylene, polypropylene, polyvinyl chloride, polystyrene, polyethylene terephthalate, and/or the like), different metal alloys (whose major component could be copper, zinc, tin, iron, nickel, gold, and/or the like), lumber (e.g., beech, oak, maple, pine, ash, mahogany, walnut, and/or the like) or lumber composites (e.g., plywood, densified wood, chemically densified wood, fireboard, particle board, oriented strand board, laminated timber, laminated veneer, cross laminated timber, parallel strand lumber, laminated strand lumber, finger joints, beams, trusses, transparent wood composites, and/or the like). The window frame 100 described herein may also be used to receive and/or hold solar panels of different varieties including, but not limited to, monocrystalline solar panels, polycrystalline solar panes, thin-film: amorphous silicon solar panels or concentrated PV cell panels.

In considering window design, elements described herein any be applied to single-hung windows, double-hung windows, oriel windows, cottage windows, two-panel slider windows, three-panel slider windows, picture windows, deadlites, hopper windows, casement windows, transoms windows, jalousie windows, garden style windows, glass block windows, storm windows, egress windows, skylight windows, round windows, arched windows, awning windows, picture windows, transom windows, sliding windows, stationary windows, bay windows, bow windows, and/or any other type of window.

While various implementations in accordance with the disclosed principles have been described above, it should be understood that they have been presented by way of example only, and are not limiting. Thus, the breadth and scope of the implementations should not be limited by any of the above-described exemplary implementations, but should be defined only in accordance with the claims and their equivalents issuing from this disclosure. Furthermore, the above advantages and features are provided in described implementations, but shall not limit the application of such issued claims to processes and structures accomplishing any or all of the above advantages. Any component of any system may be combined with any component of any other system (and/or the same system). Any step of any method and/or process may be combined with any other step (or a same step) of any other (or same) method and/or process. Any system operable to realize a described method or process could be used. A described system could be configured to carry out any method, step, and/or procedure which the system is operable to carry out.

Various terms used herein have special meanings within the present technical field. Whether a particular term should be construed as such a "term of art," depends on the context in which that term is used. "Connected to" or other similar terms should generally be construed broadly to include situations where connections are direct between referenced elements or through one or more intermediaries between the referenced elements. These and other terms are to be construed in light of the context in which they are used in the present disclosure and as those terms would be understood by one of ordinary skill in the art would understand those terms in the disclosed context. The above definitions are not exclusive of other meanings that might be imparted to those terms based on the disclosed context.

Words of comparison, measurement, and timing such as "at the time," "equivalent," "during," "complete," and the like should be understood to mean "substantially at the time," "substantially equivalent," "substantially during," "substantially complete," etc., where "substantially" means that such comparisons, measurements, and timings are practicable to accomplish the implicitly or expressly stated desired result.

Additionally, any section headings provided herein are for consistency with the suggestions under 37 C.F.R. 1.77 or otherwise to provide organizational cues. These headings shall not limit or characterize the implementations set out in any claims that may issue from this disclosure. Specifically and by way of example, although the headings may refer to a "Technical Field," such claims should not be limited by the language chosen under this heading to describe the so-called technical field. Further, a description of a technology in the "Background" is not to be construed as an admission that technology is prior art to any implementations in this disclosure. Neither is the "Summary" to be considered as a characterization of the implementations set forth in issued claims. Furthermore, any reference in this disclosure to "implementation" in the singular should not be used to argue that there is only a single point of novelty in this disclosure. Multiple implementations may be set forth according to the limitations of the multiple claims issuing from this disclosure, and such claims accordingly define the implementations, and their equivalents, that are protected thereby. In all instances, the scope of such claims shall be considered on their own merits in light of this disclosure, but should not be constrained by the headings herein.

Additionally, although similar reference numbers may be used to refer to similar elements for convenience, it can be appreciated that each of the various example implementations may be considered distinct variations.

Each disclosed method and method step may be performed in association with any other disclosed method or method step and in any order according to some embodiments. Where the verb "may" appears, it is intended to convey an optional and/or permissive condition, but its use is not intended to suggest any lack of operability unless otherwise indicated. Where open terms such as "having" or "comprising" are used, one of ordinary skill in the art having the benefit of the instant disclosure will appreciate that the disclosed features or steps optionally may be combined with additional features or steps. Such option may not be exercised and, indeed, in some embodiments, disclosed systems, compositions, apparatuses, and/or methods may exclude any other features or steps beyond those disclosed herein. Elements, devices, methods, and method steps not recited may be included or excluded as desired or required. Persons skilled in the art may make various changes in methods of preparing and using a device and/or system of the disclosure.

Also, where ranges have been provided, the disclosed endpoints may be treated as exact and/or approximations as desired or demanded by the particular embodiment. Where the endpoints are approximate, the degree of flexibility may vary in proportion to the order of magnitude of the range. For example, on one hand, a range endpoint of about 50 in the context of a range of about 5 to about 50 may include 50.5, but not 52.5 or 55 and, on the other hand, a range endpoint of about 50 in the context of a range of about 0.5 to about 50 may include 55, but not 60 or 75. In addition, it may be desirable, in some embodiments, to mix and match range endpoints. Also, in some embodiments, each figure disclosed (e.g., in one or more of the examples, tables, and/or drawings) may form the basis of a range (e.g., depicted value+/− about 10%, depicted value+/− about 50%, depicted value+/− about 100%) and/or a range endpoint. With respect to the former, a value of 50 depicted in an example, table, and/or drawing may form the basis of a range of, for example, about 45 to about 55, about 25 to about 100, and/or about 0 to about 100. Disclosed percentages are weight percentages except where indicated otherwise.

It will be understood that particular embodiments described herein are shown by way of illustration and not as limitations of the disclosure. The principal features of this disclosure can be employed in various embodiments without departing from the scope of the disclosure. Those skilled in the art will recognize, or be able to ascertain using no more than routine experimentation, numerous equivalents to the specific procedures described herein. Such equivalents are considered to be within the scope of this disclosure and are covered by the claims.

The title, abstract, background, and headings are provided in compliance with regulations and/or for the convenience of the reader. They include no admissions as to the scope and content of prior art and no limitations applicable to all disclosed embodiments.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, MB, BBC, AAABCCCC, CBBAAA, CABABB, and so forth. The skilled artisan will understand that typically there is no limit on the number of items or terms in any combination, unless otherwise apparent from the context.

All of the compositions and/or methods disclosed and claimed herein can be made and executed without undue experimentation in light of the present disclosure. While the compositions and methods of this disclosure include preferred embodiments, it will be apparent to those of skill in the art that variations may be applied to the compositions and/or methods and in the steps or in the sequence of steps of the method described herein without departing from the concept, spirit and scope of the disclosure. All such similar substitutes and modifications apparent to those skilled in the art are deemed to be within the spirit, scope and concept of the disclosure as defined by the appended claims.

Each of the following concurrently filed and commonly owned applications are incorporated by reference in their entirety: U.S. patent application Ser. No. 16/046,226, entitled Male and Female Gasket Coupling for a Window Frame and filed on Jul. 26, 2018; U.S. patent application Ser. No. 16/046,317, entitled Sill Track Seal for a Window Frame and filed on Jul. 26, 2018; U.S. patent application Ser. No. 16/046,333, entitled Jacking Screw for Adjusting a Window Frame and filed on Jul. 26, 2018; and U.S. patent application Ser. No. 16/046,357, entitled Heel Bead Gasket with a Glass Stop for Sealing a Window Frame and filed on Jul. 26, 2018.

What is claimed is:

1. A compression gasket comprising:

a first portion having a concave surface facing a window frame extrusion, a top end and a bottom end, wherein the top end of the first portion comprises a top foot to be received in a top cavity of the window frame extrusion, wherein the bottom end of the first portion comprises a bottom foot to be received in a bottom cavity of the window frame extrusion, wherein the top end comprises a top surface for engaging a first surface of the window frame extrusion, wherein shapes of the top and bottom feet substantially match respective contours of the top and bottom cavities, and wherein the bottom end comprises a bottom surface for engaging a second surface of the window frame extrusion; and a second portion having a surface shaped to couple with the concave surface of the first portion and comprising a plurality of angular protrusions for engaging a front window surface to create one or more seals, wherein when the plurality of angular protrusions engage the front window surface, the second portion compresses toward the first portion, causing the first portion to expand outwardly such that the top surface of the first portion exerts a first force against the first surface of the window frame extrusion and the bottom surface of the first portion exerts a second force against the second surface of the window frame extrusion.

2. The compression gasket of claim 1, wherein the compression gasket operatively couples to the window frame extrusion by:

compressing the first portion inwardly on itself by exerting at least one of a third force in the direction of the second force against the top surface and a fourth force in the direction of the first force against the bottom surface; and inserting the top and bottom feet into the top and bottom cavities, respectively, wherein, once inserted, the top and bottom feet engage the window frame extrusion so as to secure the compression gasket to the window frame extrusion.

3. The compression gasket of claim 1, wherein the first portion is comprised of a rigid material.

4. The compression gasket of claim 1, wherein the second portion is comprised of a non-rigid material.

5. The compression gasket of claim 1, wherein the first and second portions are manufactured from either different materials or a common material.

6. The compression gasket of claim 1, wherein the concave surface of the first portion and the second portion are coupled together using at least one of an adhesive, a pin, a screw, a clip, a coupling, and a bonding process.

7. The compression gasket of claim 1, wherein compression of the at least one finger-like angular protrusion causes one or more seals between the front window surface and the compression gasket.

8. A method comprising:

providing a window frame configured to receive a window, wherein the window frame comprises a window frame extrusion, the window frame extrusion comprising an opening with a first surface and a second surface opposite the first surface;

providing a compression gasket, wherein the compression gasket comprises:

a first portion having a concave surface facing the window frame extrusion, a top end and a bottom end, wherein the top end of the first portion comprises a top foot to be received in a top cavity of the window frame extrusion, wherein the bottom end of the first portion comprises a bottom foot to be received in a bottom cavity of the window frame extrusion, wherein the top end comprises a top surface for engaging the first surface of the window frame extrusion, wherein shapes of the top and bottom feet substantially match respective contours of the top and bottom cavities, and wherein the bottom end comprises a bottom surface for engaging the second surface of the window frame extrusion; and a second portion having a surface shaped to couple with the concave surface of the first portion and comprising a plurality of angular protrusions for engaging a front window surface to create one or more seals;

operatively coupling the compression gasket to the window frame by securing the first portion within the opening of the window frame extrusion; and installing the window in the window frame, wherein the plurality of angular protrusions engage the front window surface to create the one or more seals, wherein when the plurality of angular protrusions engage the front window surface, the second portion compresses toward the first portion, causing the first portion to expand outwardly such that the top surface of the first portion exerts a first force against the first surface of the window frame extrusion and the bottom surface of the first portion exerts a second force against the second surface of the window frame extrusion.

9. The method of claim 8, wherein operatively coupling the compression gasket to the window frame further comprises:

compressing the first portion inwardly on itself by exerting at least one of a third force in the direction of the second force against the top surface and a fourth force in the direction of the first force against the bottom surface; and inserting the top and bottom feet into the top and bottom cavities, respectively, wherein once inserted, the first portion expands outwardly so that the top and bottom feet engage the window frame extrusion, thereby securing the compression gasket to the window frame.

10. The method of claim 8, wherein the first and second portions are coupled together using at least one of an adhesive, a pin, a screw, a clip, a coupling, and a bonding process.

11. A compression gasket comprising:

a first portion having a concave surface facing a window frame extrusion, a top end and a bottom end, wherein the top end of the first portion comprises a top foot to be received in a top cavity of the window frame extrusion, wherein the bottom end of the first portion comprises a bottom foot to be received in a bottom cavity of the window frame extrusion, wherein the top end comprises a top surface for engaging a first surface of the window frame extrusion, wherein shapes of the top and bottom feet substantially match respective contours of the top and bottom cavities, and wherein the bottom end comprises a bottom surface for engaging a second surface of the window frame extrusion; and a second portion having a surface shaped to couple with the concave surface of the first portion and comprising a plurality of angular protrusions for engaging a front window surface to create one or more seals, wherein when the plurality of angular protrusions engage the front window surface, the second portion compresses toward the first portion, causing the first portion to expand outwardly such that the top surface of the first portion exerts a first force against the first surface of the window frame extrusion and the bottom surface of the first portion exerts a second force against the second surface of the window frame extrusion, wherein the compression gasket operatively couples to the window frame extrusion by:

compressing the first portion inwardly on itself by exerting at least one of a third force in the direction of the second force against the top surface or a fourth force in the direction of the first force against the bottom surface, and inserting the top and bottom feet into the top and bottom cavities, respectively, wherein once inserted, the top and bottom feet engage the window frame extrusion so as to secure the compression gasket to the window frame extrusion.

12. The compression gasket of claim 11, wherein the window frame extrusion comprises an opening including:

the first surface of the window frame extrusion, and the second surface of the window frame extrusion, wherein the first surface is opposite the second surface.

13. The compression gasket of claim 11, wherein:

the first portion is comprised of a rigid material, and the second portion is comprised of a non-rigid material.

14. The compression gasket of claim 12, wherein:

the first portion is comprised of a rigid material, and the second portion is comprised of a non-rigid material.

* * * * *